US011499300B2

(12) United States Patent
Sierks et al.

(10) Patent No.: US 11,499,300 B2
(45) Date of Patent: Nov. 15, 2022

(54) SHOWER COLUMN ASSEMBLY

(71) Applicant: Spectrum Brands, Inc., Middleton, WI (US)

(72) Inventors: Erik Sierks, Lake Forest, CA (US); Evan Benstead, Los Angeles, CA (US)

(73) Assignee: Spectrum Brands, Inc., Middleton, WI (US)

( * ) Notice: Subject to any disclaimer, the term of this patent is extended or adjusted under 35 U.S.C. 154(b) by 338 days.

(21) Appl. No.: 16/790,130

(22) Filed: Feb. 13, 2020

(65) Prior Publication Data

US 2020/0263399 A1 Aug. 20, 2020

Related U.S. Application Data

(60) Provisional application No. 62/902,702, filed on Sep. 19, 2019, provisional application No. 62/806,510, filed on Feb. 15, 2019.

(51) Int. Cl.
*E03C 1/04* (2006.01)
*B05B 1/18* (2006.01)

(52) U.S. Cl.
CPC ..... *E03C 1/0408* (2013.01); *B05B 1/18* (2013.01); *E03C 2201/30* (2013.01)

(58) Field of Classification Search
CPC ..... E03C 1/04; E03C 1/0408; E03C 2201/20; E03C 2201/30; B05B 1/18
USPC ..... 4/570
See application file for complete search history.

(56) References Cited

U.S. PATENT DOCUMENTS

| | | | | |
|---|---|---|---|---|
| 3,471,872 | A | 10/1969 | Symmons | |
| 5,624,073 | A | 4/1997 | Mueller et al. | |
| 7,043,776 | B1 | 5/2006 | Wu | |
| 7,143,961 | B1 | 12/2006 | Wu et al. | |
| 8,505,567 | B1 | 8/2013 | Wu | |
| 9,273,452 | B2 | 3/2016 | Wilson | |
| 9,677,256 | B2 | 6/2017 | Wilson | |
| 9,707,574 | B2 | 7/2017 | Soetaert et al. | |
| 10,024,038 | B2 | 7/2018 | Wilson | |
| 10,422,138 | B1 | 9/2019 | Wilson | |
| 2012/0151669 | A1* | 6/2012 | Wilson | E03C 1/066 4/615 |
| 2015/0033470 | A1* | 2/2015 | Sharratt | E03C 1/0408 4/695 |
| 2017/0312768 | A1 | 11/2017 | Snitil | |
| 2017/0314240 | A1 | 11/2017 | Culmer et al. | |
| 2019/0211537 | A1* | 7/2019 | Lee | E03C 1/021 |

OTHER PUBLICATIONS

Notification of Transmittal of International Search Report and Written Opinion for International Application No. PCT/US2020/018277, dated Jun. 3, 2020, 24 total pages.

* cited by examiner

*Primary Examiner* — Huyen D Le
(74) *Attorney, Agent, or Firm* — Merchant & Gould P.C.

(57) ABSTRACT

A shower column assembly includes a shower column, and first and second shower column mounts. A showerhead is fluidically connected at a first end of the shower column, and a hand shower is fluidically connected to the shower column via a hose connection at a second end of the shower column opposite the first end. A diverter is positioned within the shower column at the supply location, and a flow selection valve is positioned offset from the diverter along a fluid path defined, at least in part, by the shower column.

19 Claims, 19 Drawing Sheets

SHOWER COLUMN ASSEMBLY

CROSS-REFERENCE TO RELATED APPLICATIONS

The present application claims the benefit of U.S. Provisional patent application Nos. 62/902,702, filed Sep. 19, 2019; and 62/806,510 filed Feb. 15, 2019; the disclosures of which are hereby incorporated by reference in their entireties.

BACKGROUND

Shower assemblies come in a variety of forms. Typical shower assemblies will include an overhead or wall-mounted water outlet leading to an overhead showerhead. In some instances, shower assemblies will include a handheld shower sprayer as well, which is fed by the same water outlet. Control over water output through the showerhead or handheld sprayer is often provided by a series of valves that allow selection between the showerhead, handheld shower, or both.

Existing shower assemblies that include both an overhead showerhead and handheld sprayer can be complex due to various water diverting and routing solutions. For example, multiple valves may exist on the showerhead and/or handheld sprayer to control water flow. Additionally, due to the various points a valve may be located, it is not uncommon to have a plurality of water flow directions within the shower column, or tubes positioned within the column to support bidirectional water flows within at least a portion of the shower column or exterior tubing. For example, in a shower column assembly, a user control valve for selecting between water flow to the showerhead or hand shower is typically placed at a convenient location to the user, e.g., on a lower portion of the shower column or on a hand shower itself. This leads to complex, multidirectional fluid flow within the shower column itself, since water would need to flow to the valve and then be selectably rerouted to either the showerhead or hand shower. Such arrangements increase cost, probability of failure, and complexity.

Still further, because shower column assemblies are mounted in such a manner that they are exposed within a shower, they are often constructed using complex alignment features to ensure that the shower column can be mounted vertically within a shower and to ensure that the shower column is configurable to the particular desired positioning of a home user. However, the various adjustable features of shower column assemblies add complexity to the installation process, which may be confusing to the home user during installation.

Accordingly, improvements in shower assemblies, and in particular shower column assemblies, are desirable.

SUMMARY

The present disclosure relates generally to a shower column assembly. In one possible configuration, and by non-limiting example, the shower column assembly includes a diverter that is positioned at a water inlet to the shower column, and which is usable to selectably direct water to a showerhead or hand shower based on water pressure generated based on an open or closed position of another valve within the assembly.

In a first aspect, a shower column assembly is connectable to a water supply having a supply pipe having a pipe outlet. The shower column assembly includes a shower column, as well as a first shower column mount and a second shower column mount. The first shower column mount includes a fluid conduit assembly connectable to a supply pipe, the fluid conduit assembly fluidically connected to the shower column at a supply location. The second shower column mount is positionable along the shower column at a secondary stabilization location. The shower column assembly further includes a showerhead fluidically connected at a first end of the shower column and a hand shower fluidically connected to the shower column via a hose connection at a second end of the shower column opposite the first end. A diverter is positioned within the shower column at the supply location, and a flow selection valve is positioned offset from the diverter along a fluid path defined, at least in part, by the shower column.

In a second aspect, a shower column assembly is connectable to a water supply having a supply pipe having a pipe outlet. The shower column assembly includes a shower column, as well as a first shower column mount and a second shower column mount. The shower column assembly further includes a showerhead fluidically connected at a first end of the shower column, and a hand shower fluidically connected to the shower column via a hose connection at a second end of the shower column opposite the first end. A diverter is positioned within the shower column at the supply location, the diverter including a diverter body and a valve core, the diverter body defining an interior body having an upper outlet and a lower outlet. The valve core is movable between first and second positions in response to fluid pressure in the shower column. In the first position, the valve core forms a fluid path between the supply pipe and the hand shower and a seal between the supply pipe and the showerhead, and in the second position, the valve core forms a fluid path between the supply pipe and the showerhead.

In a third aspect, a method of installing a shower column assembly includes affixing a first shower column mount at a supply pipe location. This includes installing a wall mount at a supply adapter extending through a wall from a supply pipe, installing an escutcheon at least partially surrounding the supply adapter, and sealingly joining a supply bracket to the supply adapter to position a shower column at a fixed distance relative to the supply pipe, the shower column being fluidically connected to the supply bracket at a first position along the shower column and including a diverter at the first position, the shower column including a first end having a showerhead and a second end having a hose connection. The method further includes affixing a second shower column mount to the wall, the second shower column mount being movable along the shower column to a selected second position, the second shower column mount including a stabilization bracket being joinable to a wall mount assembly to define an adjustable distance between the wall mount assembly and the shower column. The method also includes connecting a hand shower to the second end of the shower column via a hose at the hose connection.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
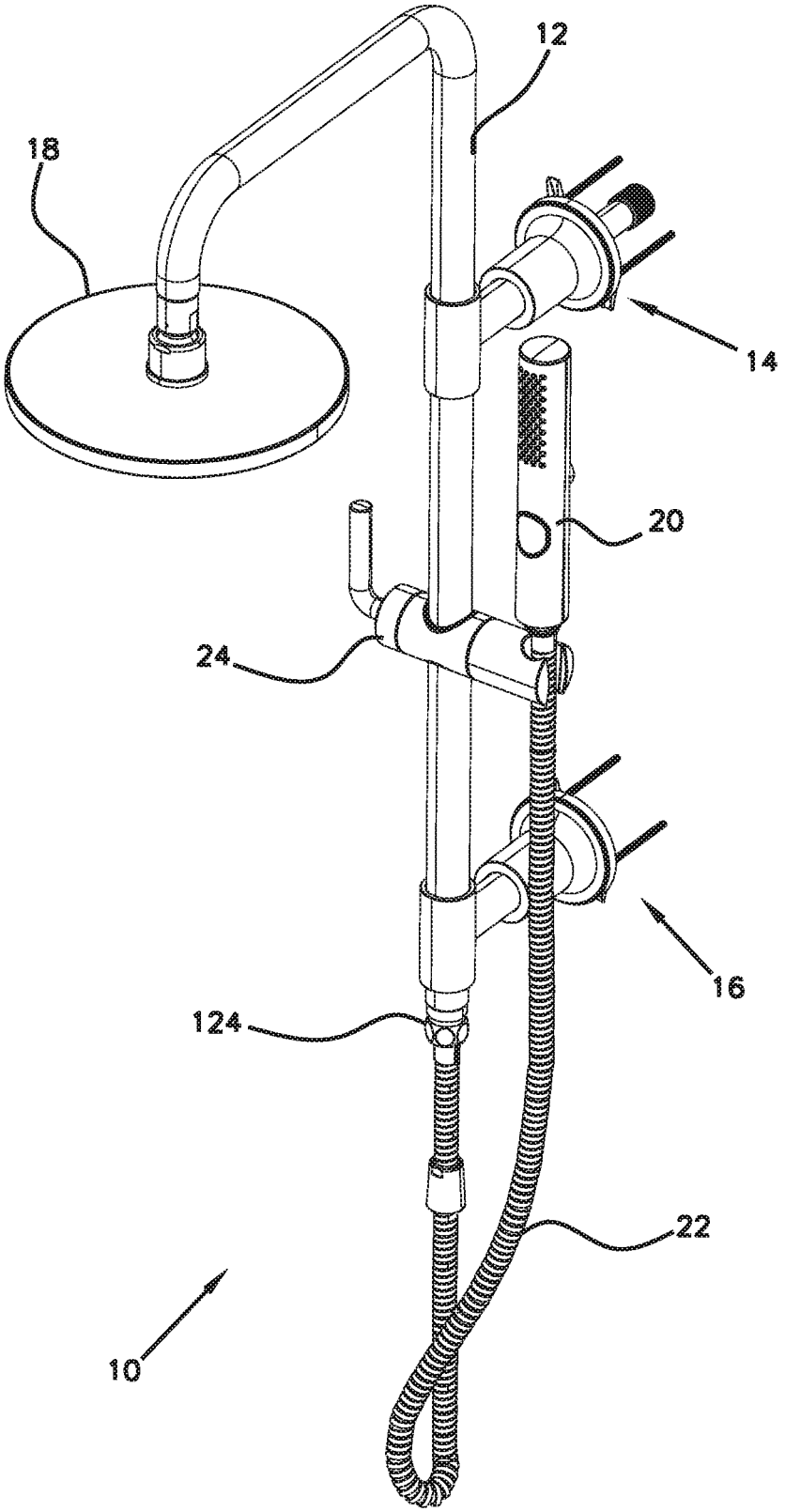
FIG. 1 illustrates a perspective view of a shower column assembly, according to one possible embodiment of the present disclosure.
Figure 2:
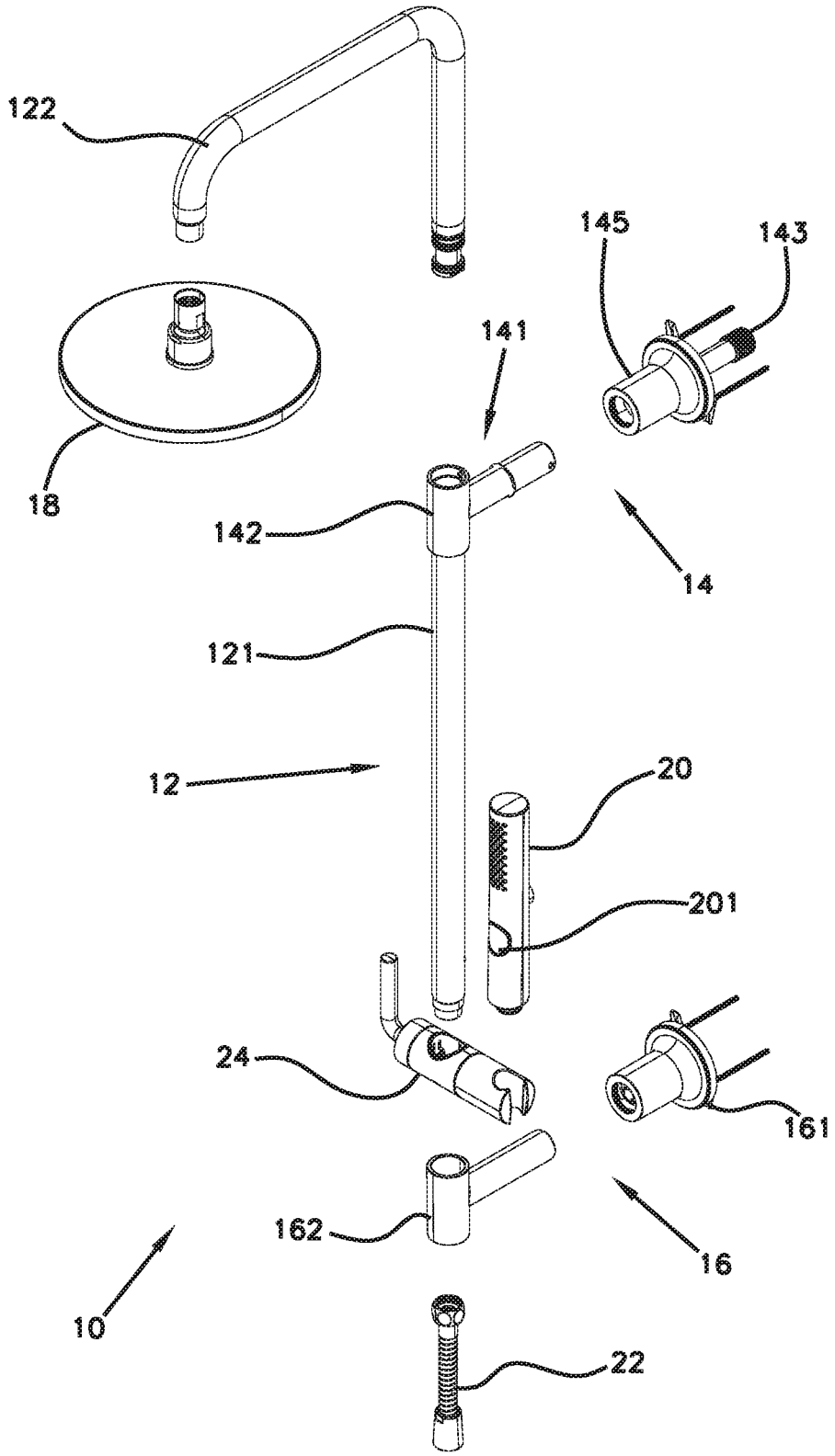
FIG. 2 is an exploded view of the shower column assembly of FIG. 1.
Figure 3:
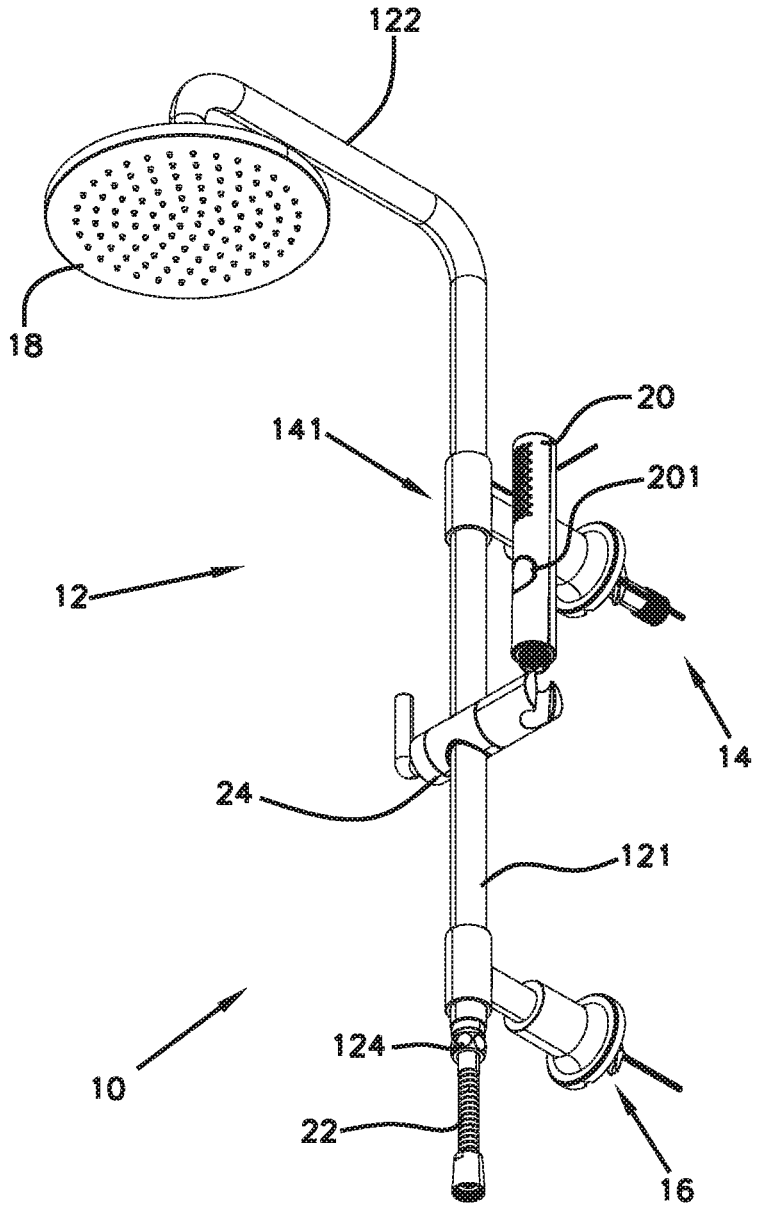
FIG. 3 is a further perspective view of the shower column assembly of FIG. 1, with a hose detached from a hand shower.
Figure 4:
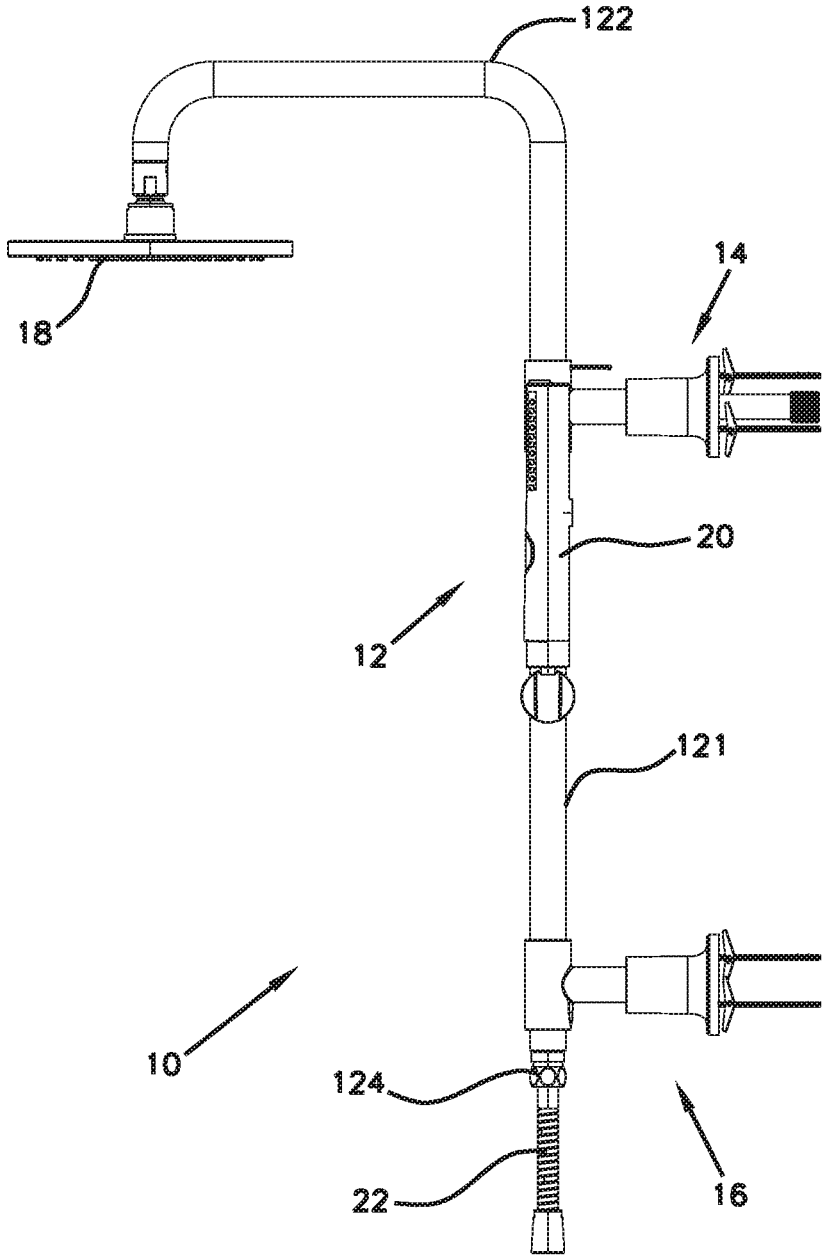
FIG. 4 is a side plan view of the shower column assembly of FIG. 1.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

As briefly described above, embodiments of the present invention are directed to a shower column assembly including a shower column. The shower column is mountable to a wall, and connectable to a water supply pipe. The shower column has a supply location that receives water from the supply pipe via a fluid conduit assembly. The shower column assembly includes a showerhead at a first end of the shower column and a hand shower connectable at the second end of the shower column opposite the first end via a hose connection. A diverter is positioned within the shower column at the supply location, and in a first embodiment, a flow selection valve is positioned toward the hand shower from the diverter along a fluid path defined, at least in part, by the shower column.

Referring now to FIGS. 1-5, a shower column assembly 10 is shown, according to an example embodiment of the present disclosure. In the example shown, the shower column assembly 10 includes a shower column 12, which is mountable to a wall using a first shower column mount 14 and a second shower column mount 16. The shower column 12 is generally positioned vertically and has opposing ends, with a showerhead 18 positioned at a first end and a hand shower 20 connectable to a second end of the shower column via a hose 22. The hand shower 20 can be retained by a hand shower mount 24 which clamps onto the shower column 12 at a user-selectable location.

In the embodiment shown, the shower column 12 has a generally straight, vertically oriented bar section 121 and a bent section 122 positioned at a first end (above the first shower column mount) leading to the showerhead 18. In example embodiments, the bent section 122, also optionally referred to herein as a showerhead extension arm, is detachable, and may be affixed in place using a hex screw. Details regarding attachment of the bar section 121 and bent section 122 are seen in further detail in FIG. 9, described below.

The shower column assembly 10 is generally attached to a wall (e.g., a wall of a shower) and is fluidically connected to a water supply line (not shown) which is typically positioned behind the wall to the showerhead 18 and/or hand shower 20. The water supply line will typically be fluidically connected to a water supply by a water supply control valve (also not shown) which is typically mounted on a wall of the shower adjacent to the shower column assembly 10. The water supply control valve will generally allow a user to turn on/off water supply and provide temperature control. In example embodiments, the water supply control valve can be a water supply mixing valve, as is generally known in the art. In some embodiments, the water supply can also be controlled by, e.g., a tub diverter valve included at a tub filler, in arrangements where the shower column assembly 10 is mounted above a tub. Other water supply control arrangements could be used as well.

The first shower column mount 14 mounts the shower column assembly 10 to a wall at a first location. The first shower column mount 14 also provides a fluidic connection to the water supply line positioned behind the wall. The first shower column mount 14 is joined to the shower column 12 at a supply location 141. In the embodiment shown, the first shower column mount 14 includes a supply bracket 142 constructed as a collar around the shower column 12 with a cylindrical aperture extending from the collar. As further discussed below, the supply bracket 142 fluidically connects to a water supply pipe via a supply adapter 143 which extends through a wall. A mounting bracket 144 mounts to the wall and surrounds, or circumscribes, at least a portion of the supply bracket 142 and/or supply adapter 143. An escutcheon 145 is then positioned over the mounting bracket 144 to provide a decorative appearance to the shower column assembly and obscure the mounting bracket 144 from view. Additional details describing the construction and installation of the first shower column mount are provided below in conjunction with FIGS. 6-9.

The second shower column mount 16 also mounts the shower column assembly 10 to a wall at a second location. In example embodiments, the second shower column mount 16 is adjustable in position along the shower column, allowing an installing user to select a distance (e.g., a vertical spacing) between the first and second shower column mounts 14, 16. The second shower column mount 16 includes a wall mount assembly 161, a stabilization bracket 162, and an escutcheon 163 that surrounds or circumscribes at least a portion of the wall mount assembly. In the example shown, the stabilization bracket 162 is formed as a collar having a cylindrical extension which is adjustably supported by the wall mount assembly 161, as further discussed below in connection with FIGS. 10-12. Generally, however, during installation, a user may select a desired distance by sliding the stabilization bracket to a desired location, and affixing the wall mount assembly 161 to a wall at the corresponding location. The stabilization bracket 162 and wall mount assembly 161 are then adjustably interconnected (as discussed below) and the escutcheon 163 affixed over the wall mount assembly. Details regarding wall mounting of both the first and second shower column mounts 14, 16 are provided below.

In the embodiment shown, the showerhead 18 is implemented as a generally cylindrical overhead shower providing a rainfall effect. However, in alternative embodiments, the showerhead can be different shapes, or be positioned in alternative locations (e.g., mounted to a vertical portion of the shower column 12 and oriented outwardly, or other configurations).

As noted above, the hand shower 20 is fluidically connected at a second end of the shower column 12 via a hose 22, which connects via a threaded hose connection 124 at the end of the shower column opposite the end from which the showerhead 18 extends. In the embodiment shown, the hand shower 20 is generally cylindrical, although other shapes could be used as well. In the embodiment shown, the hand shower 20 includes a valve 201, shown as a push-button actuated, open/close valve (although alternative valve constructions could be used as well). The valve 201 can be used to selectably operate the hand shower 20 when water is received at the shower column assembly 10 from the supply pipe. Details of the valve 201 and hand shower 20 generally are discussed further below in connection with FIGS. 21-23.

The hose 22 is generally a flexible, pressure-withstanding fluid conduit, and in the embodiment shown, has one or more threaded connections. In the embodiment shown, when interconnected to the hand shower 20 and the shower column 12, the hose extends axially from the shower column, to provide a streamlined appearance and omnidirectional use by way of hose flexion. The hose 22 optionally also extends from an end of the hand shower 20, and can be connected by a threaded or crimped connection to the hand shower 20 as well. In example embodiments, the hose can be constructed from any of a variety of flexible materials, such as a braided metal surrounding a rubber or plastic core, or a cross-linked polyethylene (PEX). Other materials may be utilized as well.

The hand shower 20 is joined to the hose 22 at a tapered end, which can be held by the hand shower mount 24 at a desired height along the shower column 12. The hand shower mount 24 has a tapered aperture 241 sized to receive a base of the hand shower 20 and allow hose 22 to pass therethrough. The hand shower mount 24 also includes a clamp handle 242 and clamp body 243, with the clamp handle being operable by a user to loosen a frictional attachment to the shower column 12 and slide the hand shower mount to a desired height before re-tightening the clamp body 243 via the handle 242. Details regarding an interior construction of the hand shower mount 24 are provided below, in connection with FIG. 24.

It is noted that, in some embodiments, the shower column assembly 10 may be provided in an at least partially disassembled state, for example with the bent section 122 and straight section 121 of the shower column detached, and with the second shower column mount 16, the hand shower 20, the hose 22, and the hand shower mount 24 being detached from the shower column 12. In such an arrangement, during installation, the hand shower mount 24 will preferably be fed onto a lower portion of the shower column 12 prior to the collar of the stabilization bracket 162 of the second shower column mount 16. In that way, after installation, the hand shower mount 24 may be repositionable at any location between the first shower column mount 14 and second shower column mount 16 without risk of the loosened hand shower mount falling off of the shower column 12.

Figure 5:
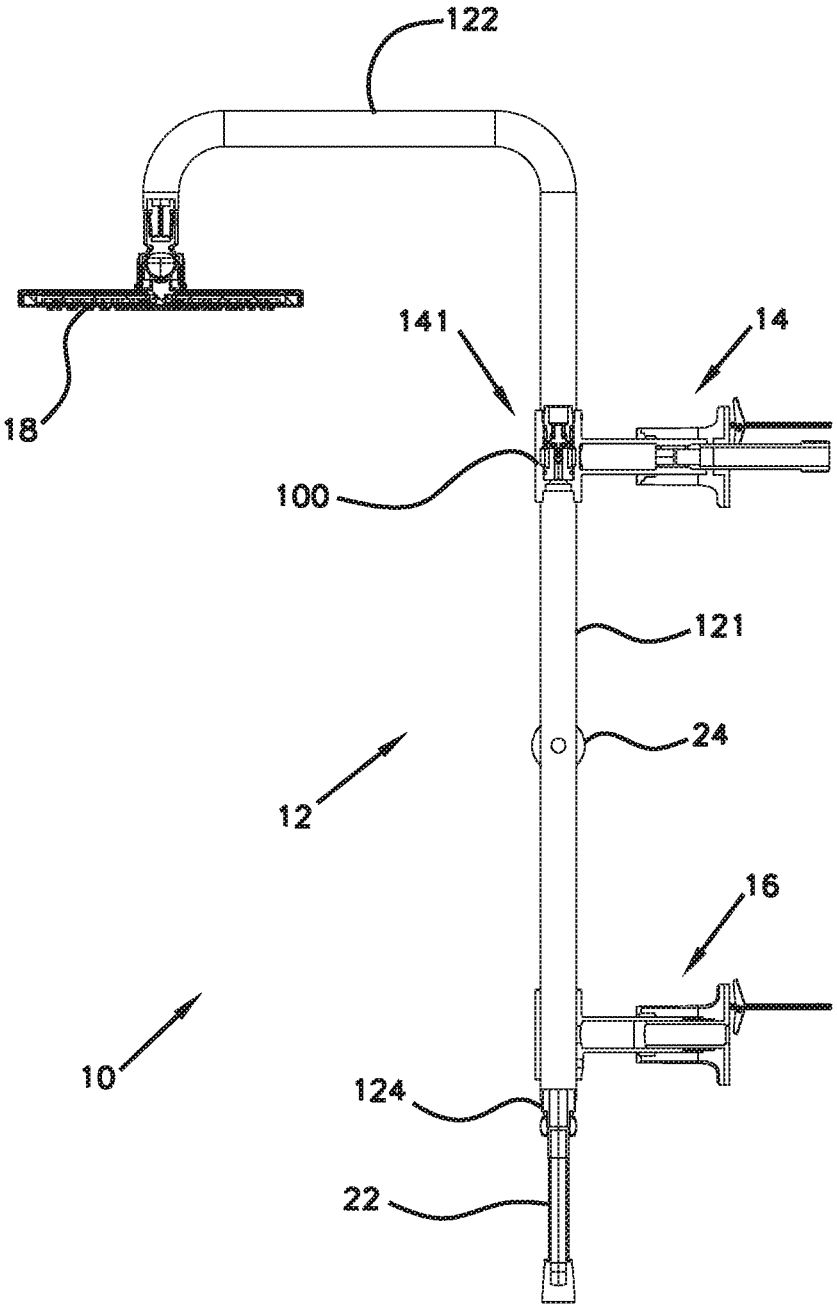
FIG. 5 is a side cross-sectional view of the shower column assembly as seen in FIG. 4, taken along a plane bisecting the shower column.
Figure 6:
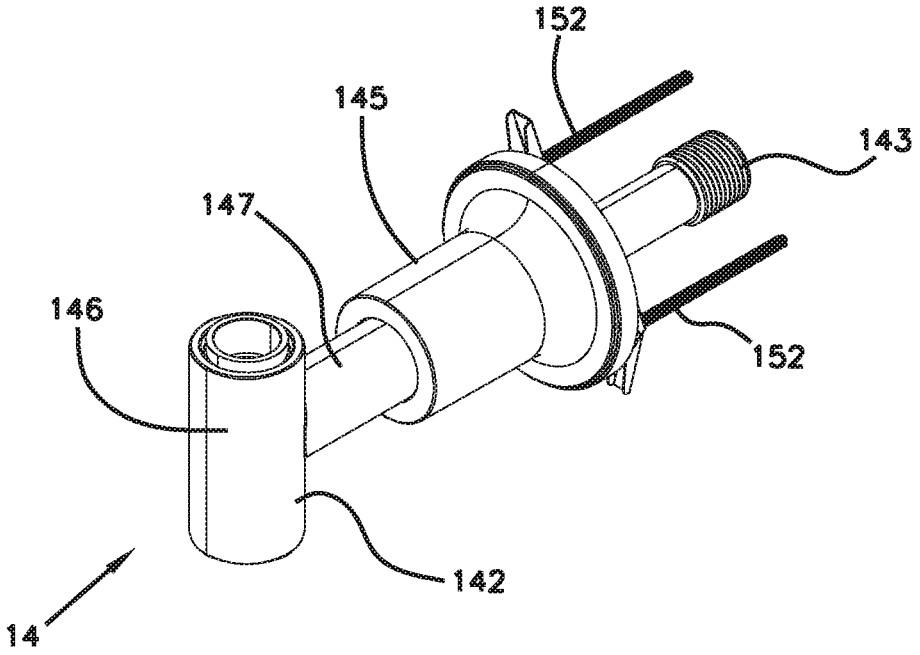
FIG. 6 is a perspective view of a first shower column mount including a fluid conduit assembly usable within a shower column assembly such as the one seen in FIGS. 1-5, according to an example embodiment.
Figure 7:
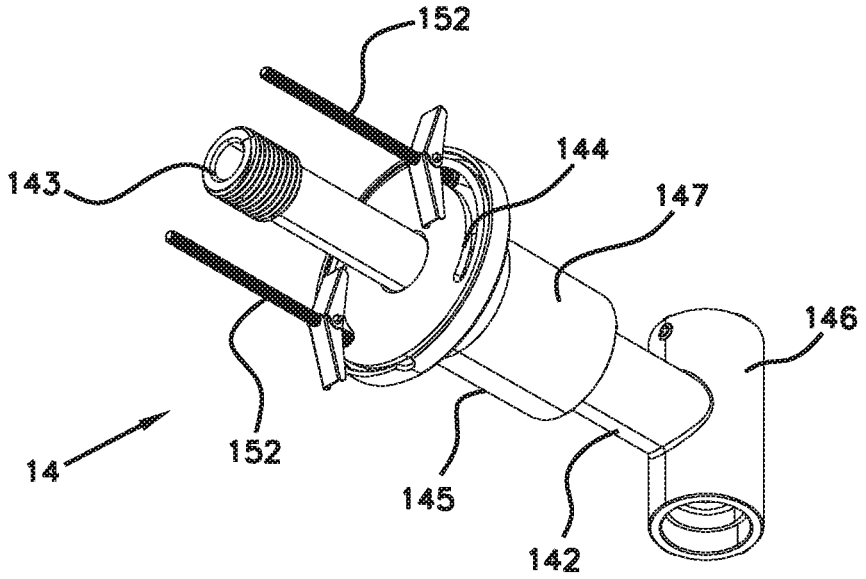
FIG. 7 is an opposite perspective view of the first shower column mount seen in FIG. 6.
Figure 8:
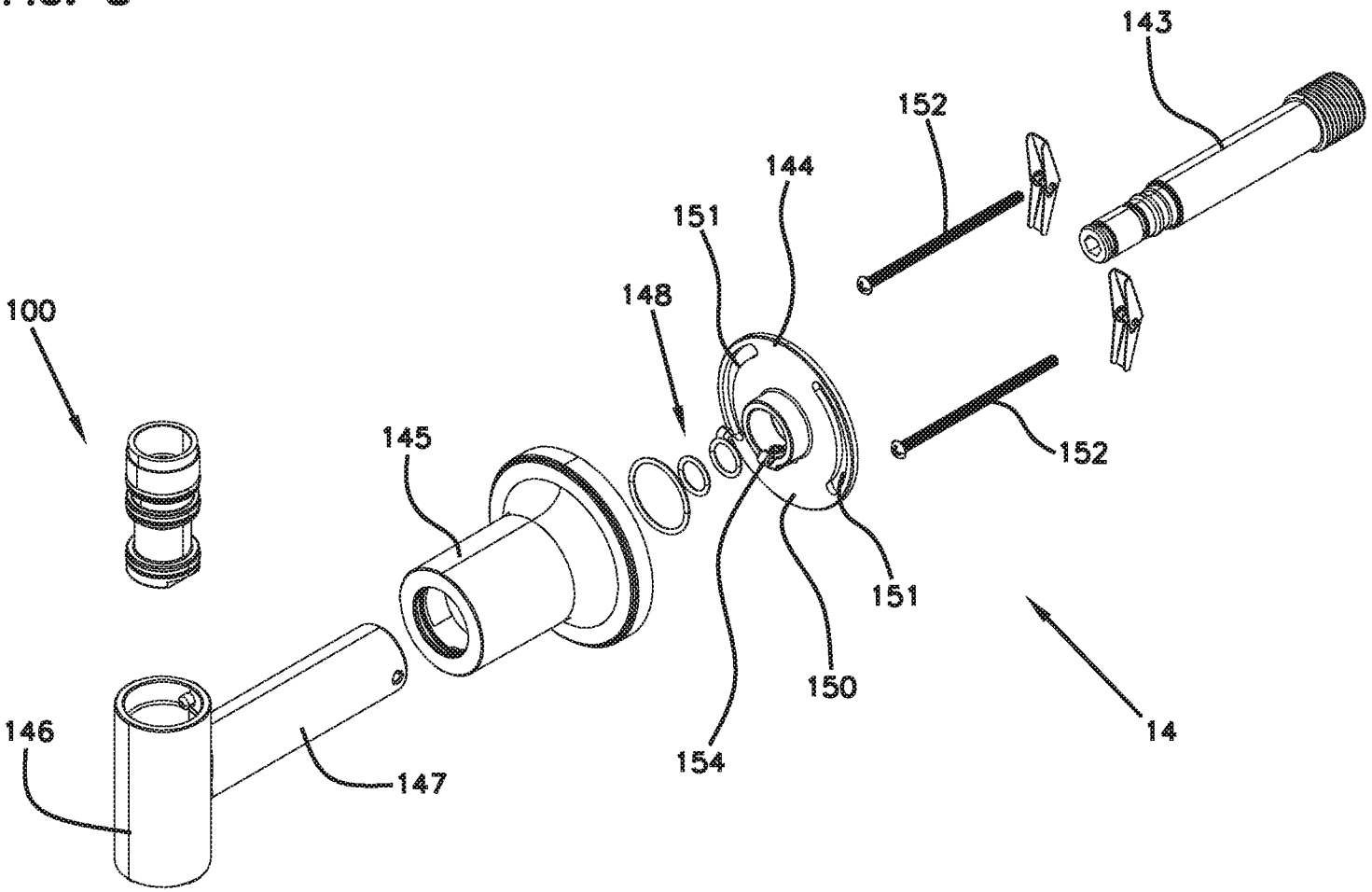
FIG. 8 is an exploded view of the first shower column mount seen in FIGS. 6-7.

In the embodiment shown, and with particular reference to FIG. 5, it is noted that the shower column assembly 10 includes a diverter 100 positioned within the shower column 12. In particular, the diverter 100 is positioned at a supply location 141 at which the first shower column mount 14 is fluidically connected to the shower column 12. Operation of the diverter 100 is described in greater detail below with respect to FIGS. 13-20; generally, the diverter 100 is operable in conjunction with a valve located toward the hand shower 20 from the diverter 100 to selectively route water from the supply pipe, through the supply bracket 142 and supply adapter 143, into the shower column 12 and either (1) to the showerhead 18, (2) to the hand shower 20, or (3) to both the showerhead 18 and hand shower 20.

As illustrated in FIG. 5, the shower column 20 is substantially hollow, forming a continuous fluid conduit between the showerhead 18 and hose 22, only interrupted by the diverter 100. Generally, the diverter 100 will move between first and second positions to alter water flow based on pressure experienced in the shower column 12, and in particular, in the straight section 121 of the shower column.

Figure 25:
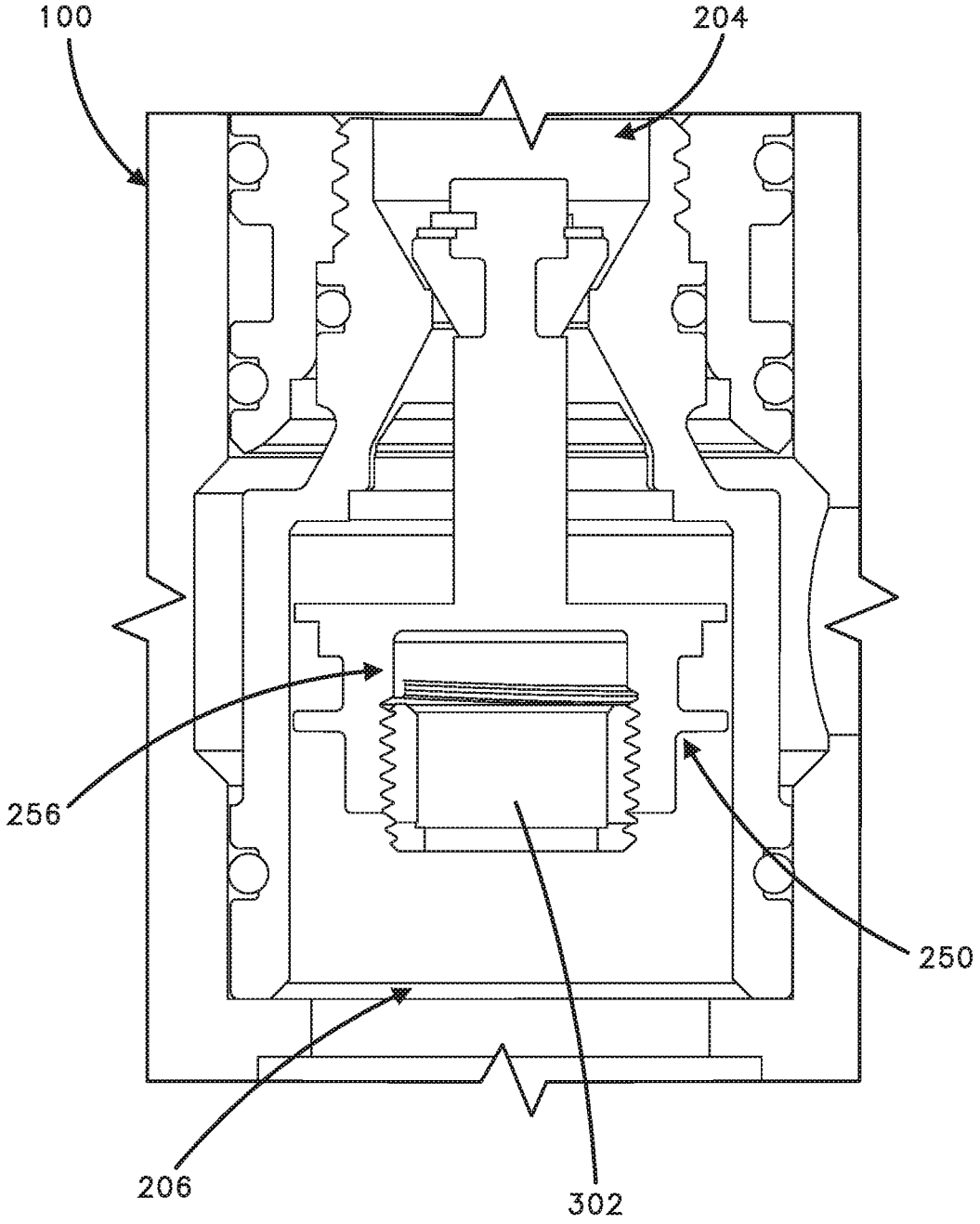
FIG. 25 is a cross-sectional view of a shower column mount having a flow restrictor.

Such changes in pressure may be the result of adjusting a valve within the shower column assembly 10 that is located toward the hand shower 20 (including at the hand shower) from the diverter 100. In some examples, as shown in FIG. 25 below, the diverter 100 includes a flow restrictor 302.

In some example embodiments, to provide flow control to the showerhead 18 and hand shower 20, the hand shower 20 will include a valve 201 integrated therein, which can be manually opened or closed. When water is received from the supply pipe and the valve 201 integrated into the hand shower 20 is open, in some embodiments, the diverter will move to (or remain in) a first position which allows water flow from the diverter down through the shower column 12 and hose 22 to be sprayed by the hand shower. When water is received from the supply pipe but the valve integrated into the hand shower 20 is closed, diverter 100 will move to a position which defines a fluid path through the diverter and to the showerhead 18, resulting in water flow to/through the showerhead 18. In some further embodiments, when adequate water pressure is provided from the supply pipe (i.e., such that water flow through the hand shower 20 is not adequate to depressurize the diverter 100, the diverter could be constructed to allow for output to both the hand shower 20 and to the showerhead 18.

Referring now to FIGS. 6-9, additional details regarding the first shower column mount 14, and its operation in conjunction with the shower column 12, are provided. In particular, the first shower column mount includes a supply bracket 142 formed to include a collar 146 and cylindrical aperture 147. The collar is sized to receive at least a portion of the shower column, such as a bent section 122 at a top side of the shower column and a straight section 121 at a bottom side. The collar also houses the diverter 100 at the supply location 141 (most clearly seen in the exploded view of FIG. 8), and as such, the collar 146 also forms a portion of the shower column 12, in the embodiment shown. Cylindrical aperture 147 extends from an opening in the collar.

The supply adapter 143 is, in the embodiment shown, a threaded pipe extension configured to be fluidically connected to a supply pipe. The supply adapter 143 has a tapered end on an opposite side to the threaded end which is sized to receive one or more fluid seals, shown as O-rings 148. The supply bracket 142 slides over the tapered end and, cooperatively with the fluid seals, forms a sealed fluid passage 149 therethrough. Accordingly, the supply adapter 143 and supply bracket 142, when installed, position the shower column 12 at a fixed distance from the supply pipe, and form a fluid conduit assembly between the shower column 12 and water supply pipe.

To hold the supply adapter 143 and supply bracket 142 in place, a mounting bracket 144 is slid over the supply adapter 143 prior to the supply adapter being joined to the supply bracket 142. The mounting bracket 144 has a flange portion 150 including slots 151, and is affixed to the wall using one or more toggle bolts 152 passing through slots in the flange portion 150. A collar portion 154 of the mounting bracket 144 can include a set screw 155 that can be tightened to grip the supply adapter 143, thereby maintaining a position of the supply adapter 143 relative to the wall.

Additionally, prior to joining the supply bracket 142 to the supply adapter 143, the escutcheon 145 is slid over an outer surface of the cylindrical aperture 147. Once the supply bracket 142 is joined to the supply adapter 143, the escutcheon 145 may be slid toward the wall (i.e., away from the collar 146) to cover the mounting bracket 144. Additional seals and/or set screws may be used to hold the escutcheon 145 in place.

Figure 9:
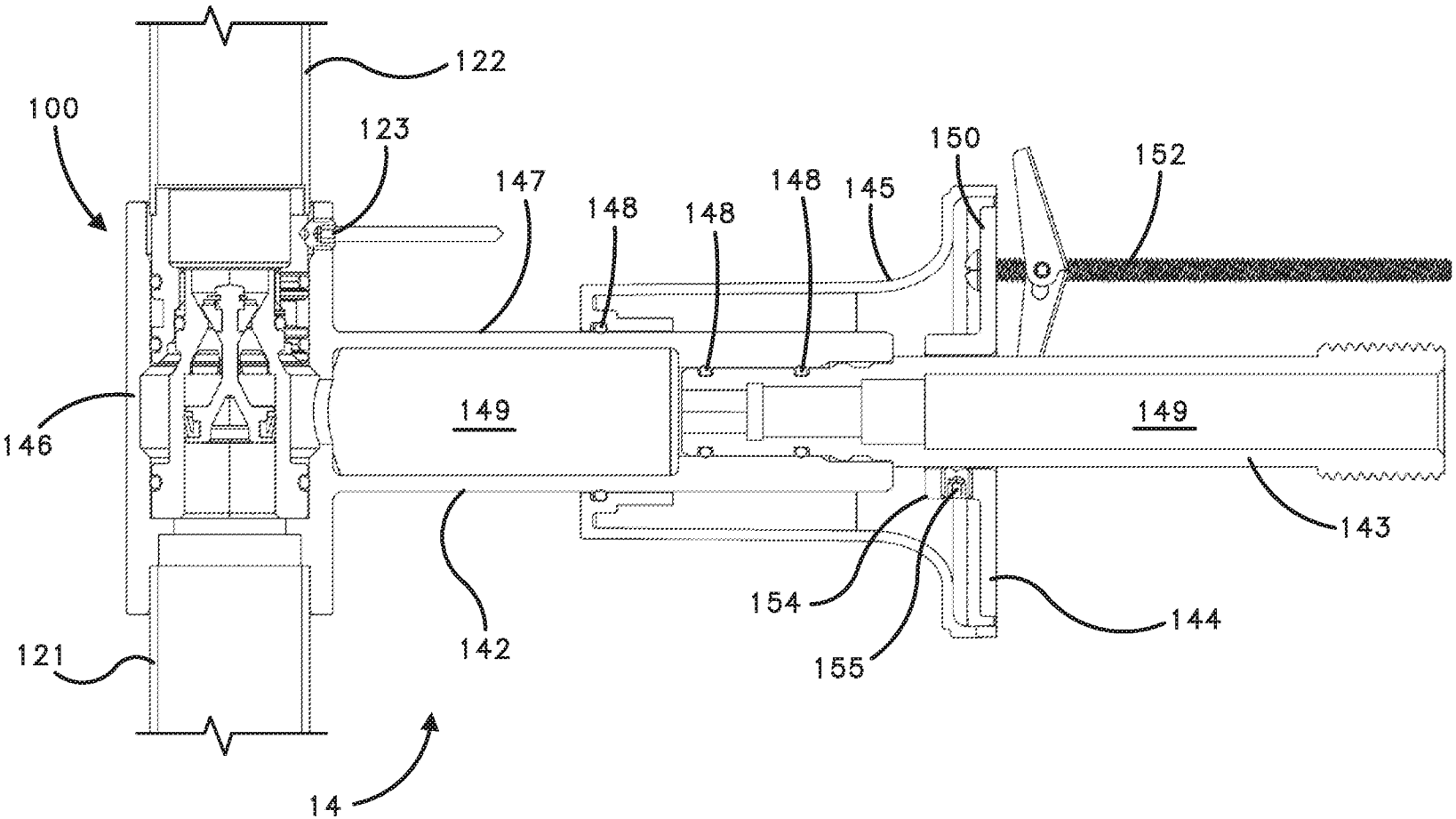
FIG. 9 is a side cross-sectional view of the first shower column mount of FIGS. 6-8 installed in a shower column assembly such as seen in FIG. 1, taken at a plane bisecting the shower column.

Accordingly, and as seen in further detail in FIG. 9, once installed, the first shower column mount 14 will form a fluidic connection from fluid passage 149 to diverter 100, positioned at the supply location 141 within the collar 146, thereby mounting the shower column 12 (including straight section 121 and bent section 122 affixed via set screw 123) in the embodiment shown.

Figure 10:
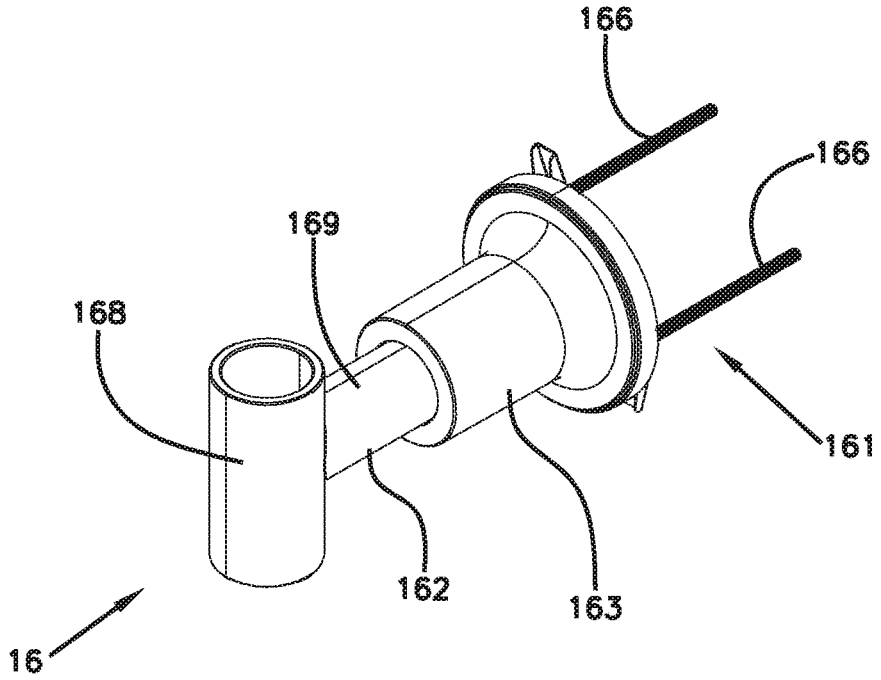
FIG. 10 is a perspective view of a second shower column mount usable within a shower column assembly such as the one seen in FIGS. 1-5, according to an example embodiment.
Figure 11:
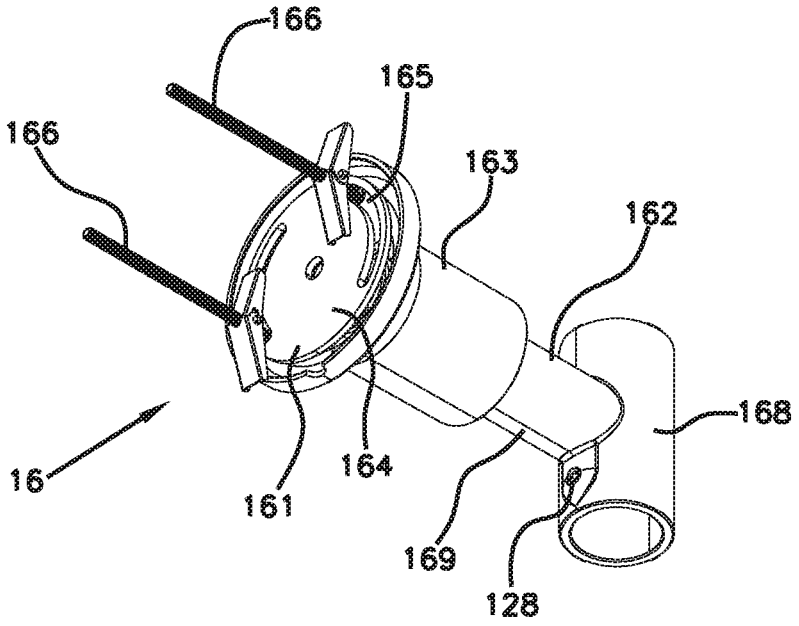
FIG. 11 is an opposite perspective view of the second shower column mount seen in FIG. 10.
Figure 12:
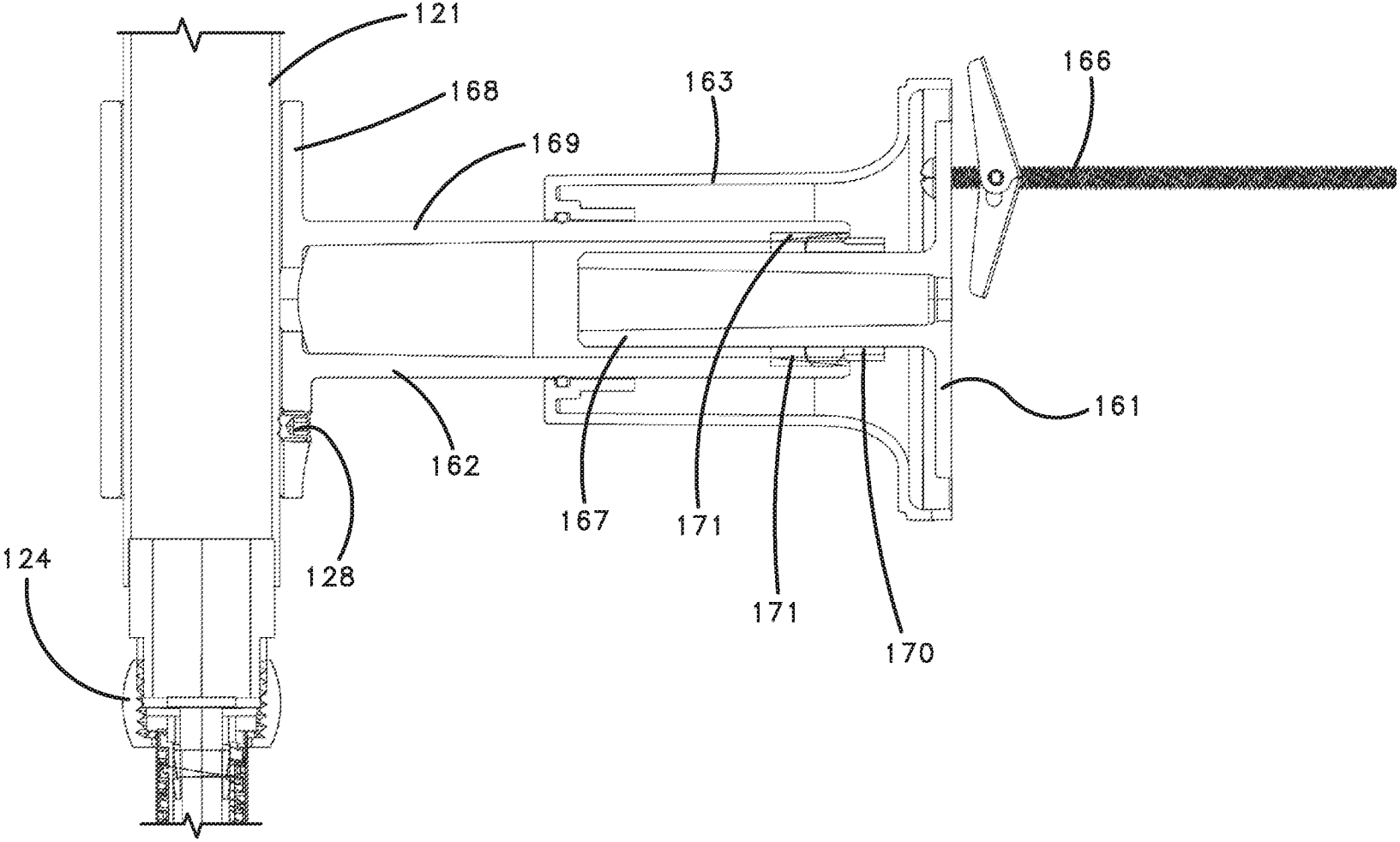
FIG. 12 is a side cross-sectional view of the second shower column mount of FIGS. 10-11 installed in a shower column assembly such as seen in FIG. 1, taken at a plane bisecting the shower column.

Referring now to FIGS. 10-12, additional details regarding the second shower column mount 16, and its use in mounting the shower column assembly 10 to a wall, are provided. In general, the second shower column mount 16 includes a wall mount assembly 161, a stabilization bracket 162, and an escutcheon 163. The wall mount assembly 161, similar to mounting bracket 144 of the first shower column mount 14, includes a flange portion 164 including slots 165 that can receive toggle bolts 166 for mounting the wall mount assembly 161 to a wall at a desired location spaced apart from the first shower column mount 14. The wall mount assembly 161 includes a mounting protrusion 167 extending away from the flange portion 164 toward the stabilization bracket 162.

The stabilization bracket 162 includes a collar 168 and a cylindrical extension 169 having an interior diameter slightly larger than an exterior diameter of the mounting protrusion 167. As such, the stabilization bracket 162 can be slid over the mounting protrusion 167 to hold the stabilization bracket 162 in place. To control the distance the stabilization bracket 162 (and therefore the shower column 12) is positioned from the wall, a compression collar 170 can be fitted around the mounting protrusion 167 at a desired location, and engaged with a flanged interior surface 171 of the cylindrical extension 169 to compress the collar 170 around the mounting protrusion 167 and frictionally retain the stabilization bracket 162 at a fixed position relative to the mounting protrusion 167.

As with the first shower column mount, the escutcheon 163 is placed around the cylindrical extension 169 prior to joining the stabilization bracket 162 to the wall mount assembly 161. Once the stabilization bracket 162 and the wall mount assembly 161 are interconnected, the escutcheon 163 can be slid into place to cover the wall mount assembly 161, and optionally maintained by a set screw or other retention mechanism. The stabilization bracket 162 can then be affixed in place along the shower column 12 via a set screw 128.

Referring to FIGS. 13-20, additional details regarding structure and operation of a diverter 100 are provided. Generally, diverter 100 is adapted for use within the shower column assembly 10 of the present disclosure. The diverter 100 is constructed from a diverter body 200 and a valve core 250.

Figure 13:
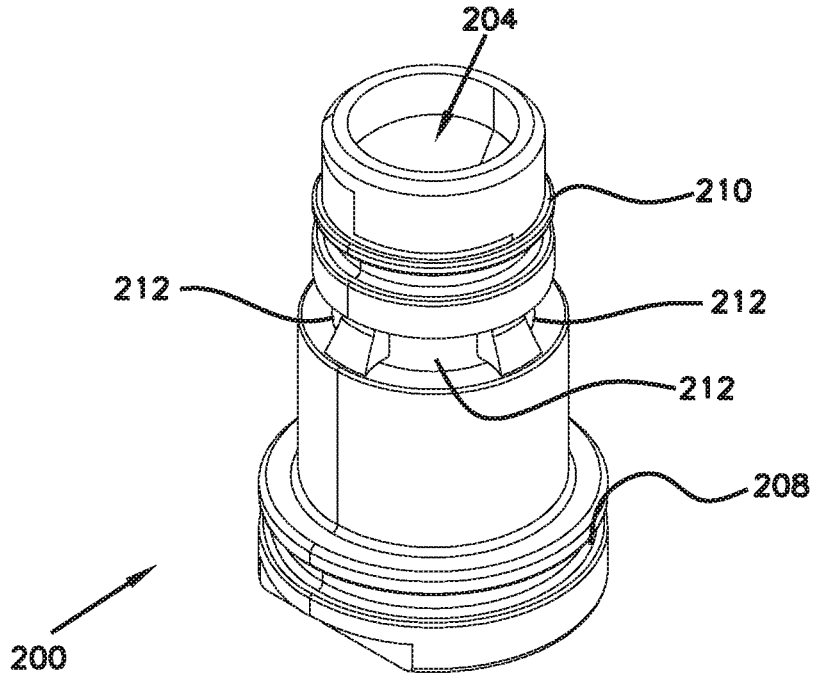
FIG. 13 is a top perspective view of a diverter body usable within embodiments of the shower column assembly described herein.
Figure 14:
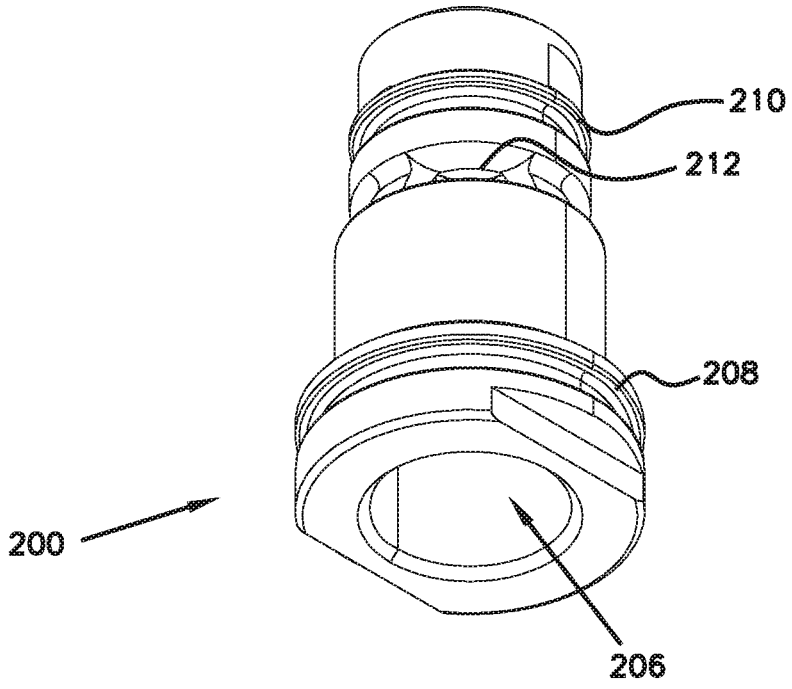
FIG. 14 is a bottom perspective view of the diverter body of FIG. 13.
Figure 15:
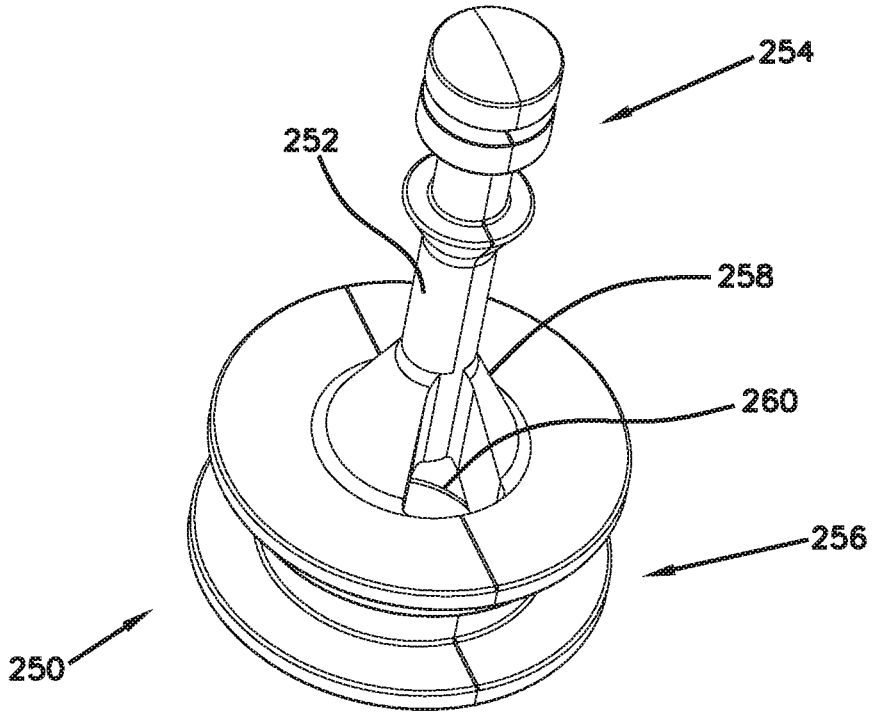
FIG. 15 is a top perspective view of a valve core usable within the diverter body of FIGS. 14-15 to form a diverter, according to an example embodiment.
Figure 16:
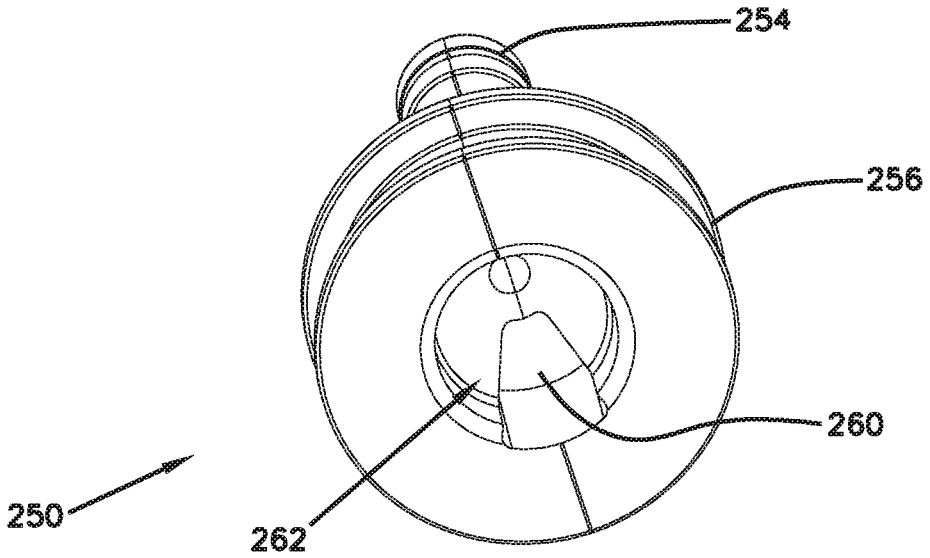
FIG. 16 is a bottom perspective view of the valve core of FIG. 15.
Figure 17:
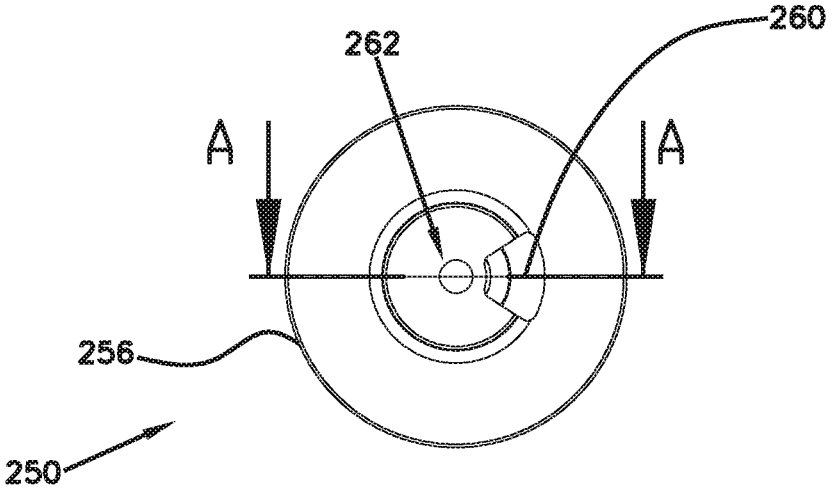
FIG. 17 is a bottom plan view of the valve core of FIG. 15.
Figure 18:
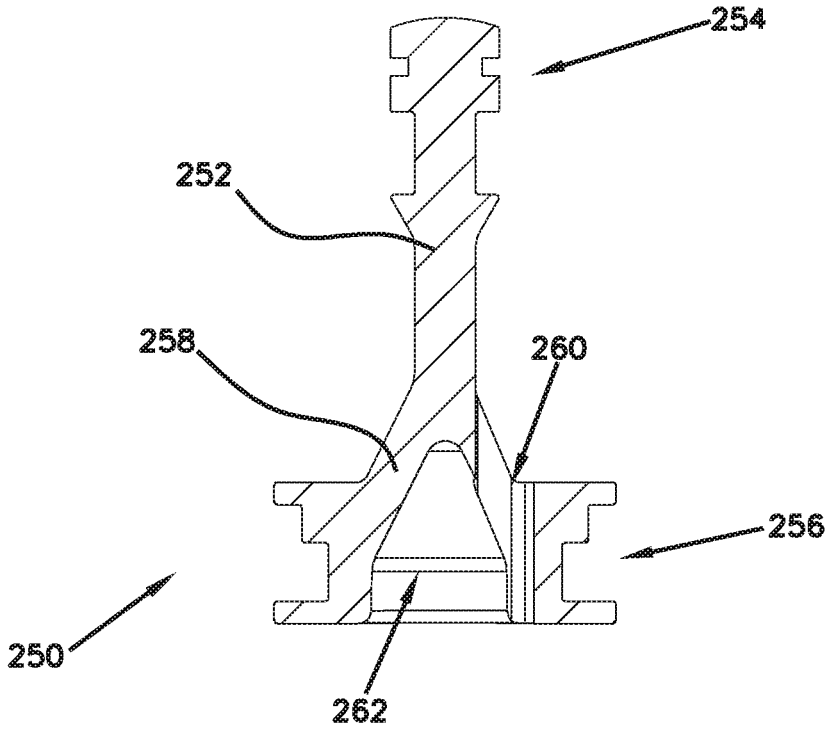
FIG. 18 is a side cross-sectional view of the valve core of FIG. 15, taken along the axis A designated in FIG. 17.

The diverter body 200 is seen in FIGS. 13-14, according to one example embodiment. In the example shown, the diverter body 200 is generally cylindrical and is seated within the shower column 12, in particular in a region near the collar 146 at supply location 141. The diverter body 200 has an interior chamber 202, and upper and lower outlets 204, 206, respectively. The upper and lower outlets 204, 206 allow water to flow toward the showerhead 18 and hand shower 20, respectively, when the diverter is positioned within the shower column.

Figure 19:
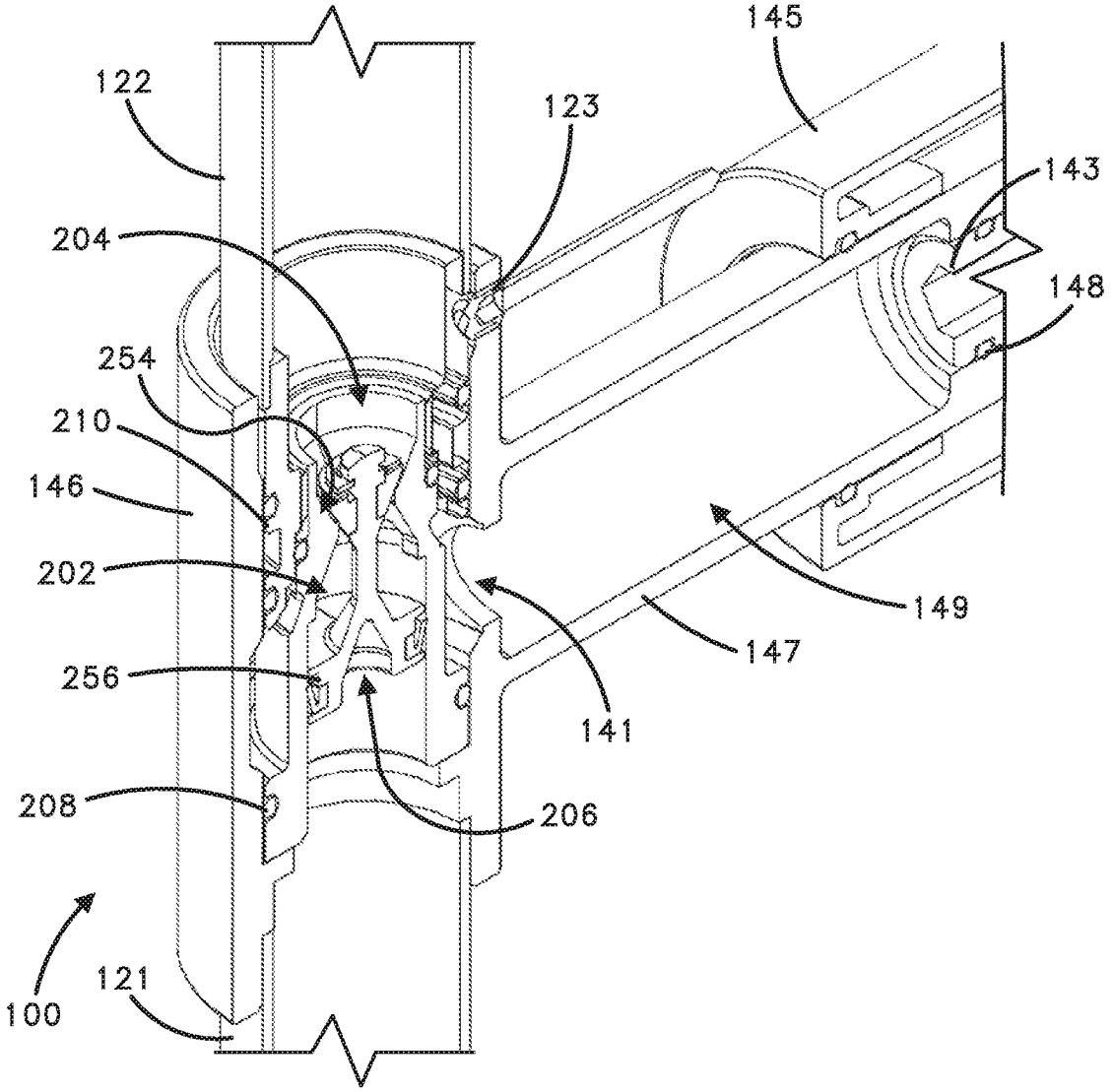
FIG. 19 is a perspective cross-sectional view of a portion of the shower column assembly of FIG. 1, taken along a plane bisecting the shower column illustrating a diverter in a first position and associated water flow.
Figure 20:
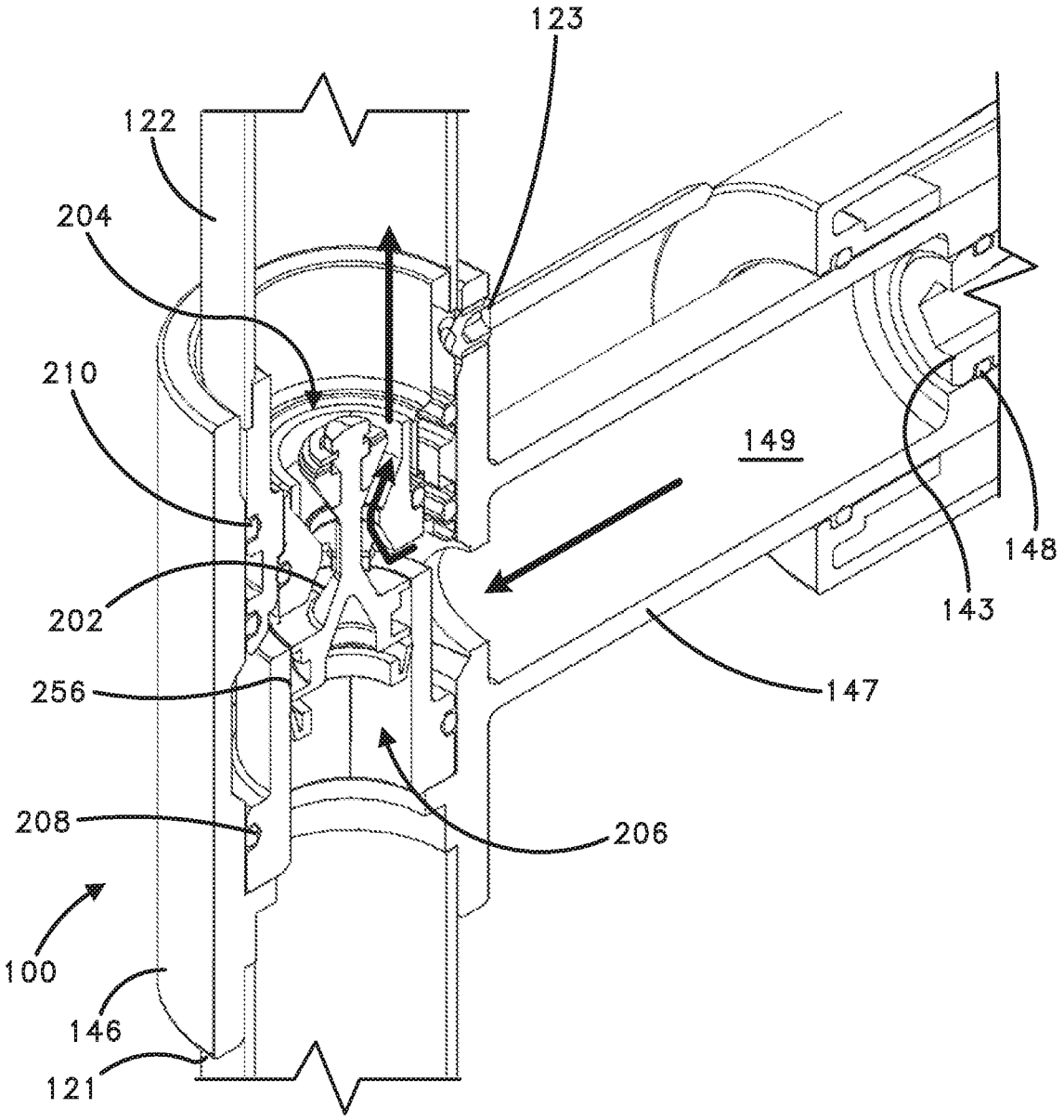
FIG. 20 is a perspective cross-sectional view of a portion of the shower column assembly of FIG. 1, taken along a plane bisecting the shower column and illustrating a diverter in a second position and associated water flow.

In the embodiment shown, the diverter body 200 has a lower seal 208 and an upper seal 210. As seen in FIGS. 19-20, the lower and upper seals 208, 210 form a seal against an interior surface of the collar 146.

In the embodiment shown, the diverter body 200 includes one or more fluid inlet locations 212. The fluid inlet locations 212 are positioned between the upper and lower seals 208, 210, and provide a fluidic connection between the interior chamber 202 and a fluid conduit assembly, and in particular through the fluid passage 149 from the water supply pipe.

Referring to FIGS. 15-18, details regarding a valve core 250 used in conjunction with the diverter body are now provided. In general the valve core 250 includes a stem portion 252 extending between an upper seal portion 254 and a lower seal portion 256. The stem portion 252 includes a conical base section 258 having at least one fluid aperture 260 therethrough. The fluid aperture 260 extends between an area proximate to the stem portion 252 and a conical lower chamber 262. When the valve core 250 is positioned within the diverter body 200, the fluid aperture 260 provides fluid communication between the interior chamber 202 and the lower outlet 206.

Interrelationships among the diverter body 200, the valve core 250, and other components of the shower column assembly 10 are illustrated in further detail in FIGS. 19-20. FIG. 19 represents a state of the shower column assembly 10, and diverter 100 in particular, either in a state where no water pressure is applied to the diverter, or where a user has selected to activate the hand shower 20 (e.g., by opening valve 201 on the hand shower). In such a circumstance, the valve core 250 will be positioned such that the upper seal portion 254 is seated within the upper outlet 204, forming a seal and preventing water from flowing upward toward the showerhead 18. As such, any water introduced via the fluid passage 149 will pass through the fluid inlet locations 212 to the interior chamber 202, through the fluid aperture 260, and into a lower portion of the shower column 12, to proceed through hose 22 and hand shower 20.

FIG. 20 illustrates a second position of the diverter 100 in which water flow toward the showerhead 18 is provided. This may be the case, for example, if sufficient pressure is introduced to the diverter 100, e.g., where valve 201 is closed and therefore a pressure differential between the interior chamber 202 and the upper outlet 204 is greater than a pressure differential between the interior chamber 202 and lower outlet 206. In other words, water pressure introduced through the fluid passage will pressurize the interior chamber and at least partially pressurize (and optionally fill) a lower portion of the shower column 12 up to the valve 201; however, because the portion of the shower column extending from the upper outlet 204 (e.g., the bent section 122 of the shower column 12) has no valve, the interior of that portion of the shower column remains at atmospheric pressure. This pressure differential will cause movement of the valve core 250 from the position seen in FIG. 19 to the position seen in FIG. 20. In this arrangement, water will be allowed to proceed from the fluid passage 149, through the fluid inlet locations 212, and out through the upper outlet 204, since movement of the valve core 250 to the position in FIG. 20 opens the sealed passage that is present in FIG. 19 (as reflected by water flow arrows).

In accordance with operation of the diverter 100 as seen in FIGS. 19-20, and referring to FIGS. 1-20 generally, the shower column arrangements according to the embodiments disclosed herein have a number of advantages. Specifically, use of a diverter at the supply location provides flexibility with respect to selectable water flow to the hand shower and/or showerhead while maintaining simplicity of internal components within the shower column. For example, because the diverter is at the supply location, there is no need for bidirectional water flow within the shower column, and instead, the entire shower column can be used as a water conduit. In other words, water in any one section of the shower column 12 flows in a single direction, away from the diverter 100 and toward either showerhead 18 or hand shower 20. This simplifies construction of a shower column and also allows designers to control water flow rates at the diverter, showerhead, and hand shower more easily, since water flow is not constricted within the shower column. Still further, such simplification reduces the likelihood of failure of the shower column, and places the valve portions of the overall assembly (e.g., the diverter and a valve, discussed below) at readily reachable/replaceable locations on the assembly.

Figure 21:
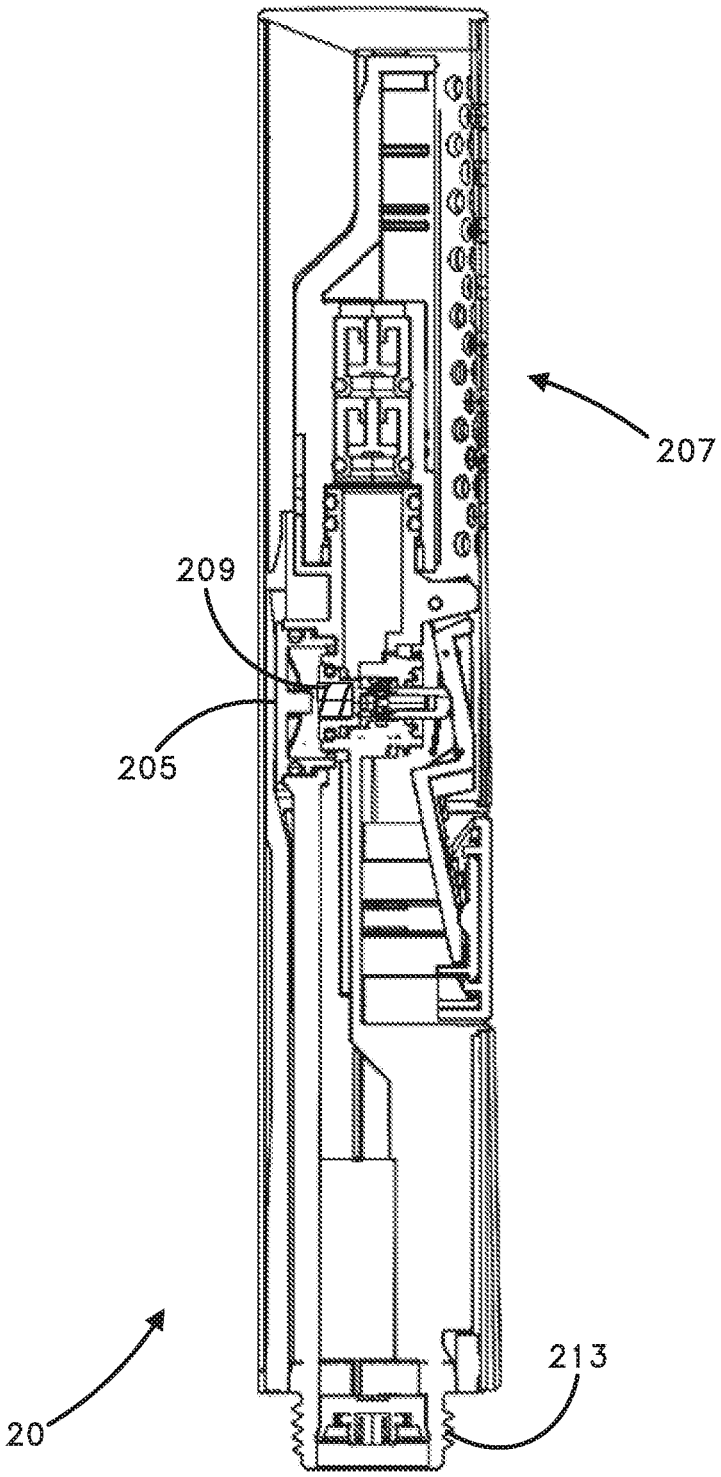
FIG. 21 is a side cross-sectional view of a hand shower usable according to aspects of the present disclosure.
Figure 22:
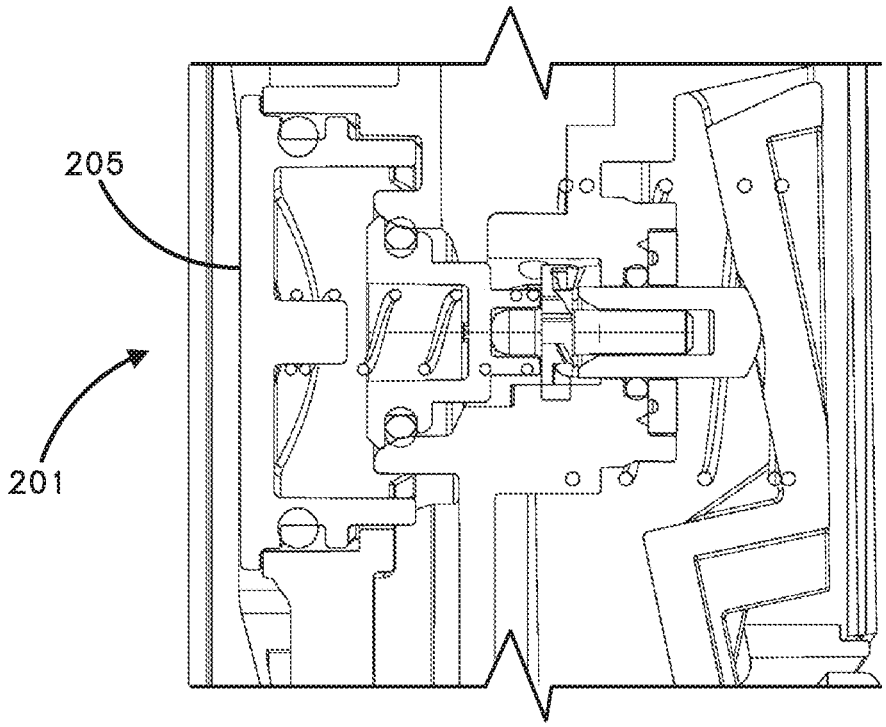
FIG. 22 is a close-up side cross-sectional view of a portion of the hand shower of FIG. 21 with a valve in a first position.
Figure 23:
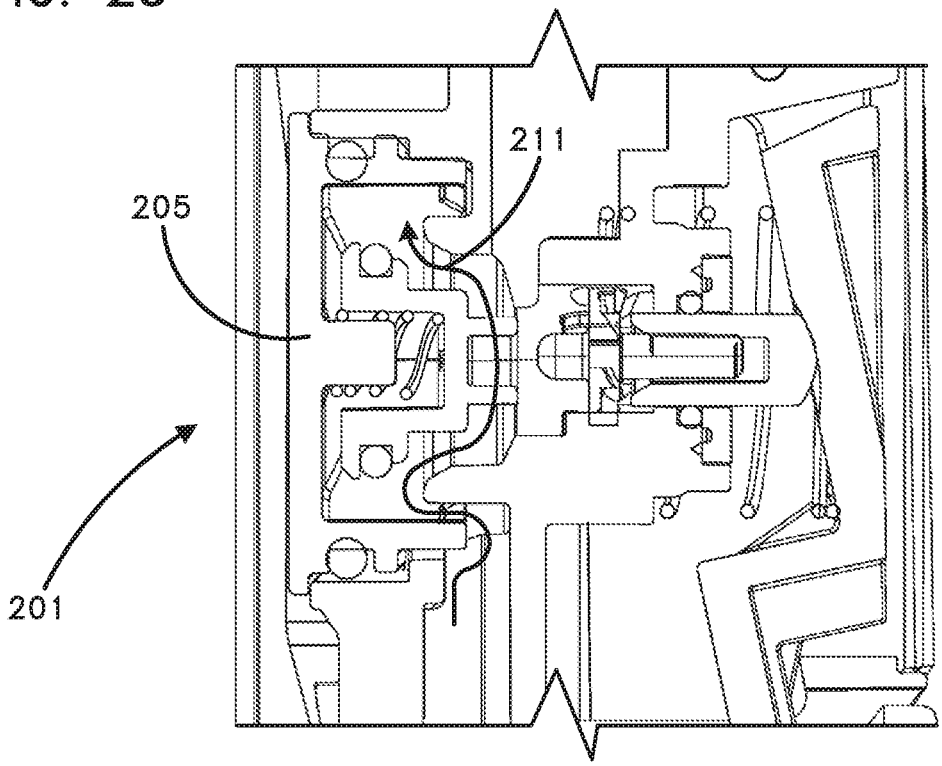
FIG. 23 is a close-up side cross-sectional view of a portion of the hand shower of FIG. 21 with a valve in a second position.

Referring now to FIGS. 21-23, details regarding a hand shower 20 are provided. Generally, the hand shower 20 includes a valve assembly 201 that is actuatable by a button 205 to selectively allow water flow to a nozzle assembly 207. Generally, the valve assembly 201 is positionable in an open position (as seen in FIG. 23) and a closed position (as seen in FIG. 22) in response to a user depressing button 205. The valve assembly 201 is spring-biased toward an open position using a spring 209, in which a fluid path 211 is provided from a hose connection point 213 to the nozzle assembly. However, when the button 205 is depressed, the valve 201 is retained in the closed position seen in FIG. 22, which prevents water from flowing to the nozzle assembly 207, and instead pressurizing the shower column 12, and causing water flow to the showerhead 18 as previously described. A second depression of the button 205 will return the nozzle assembly to the open position.

Figure 24:
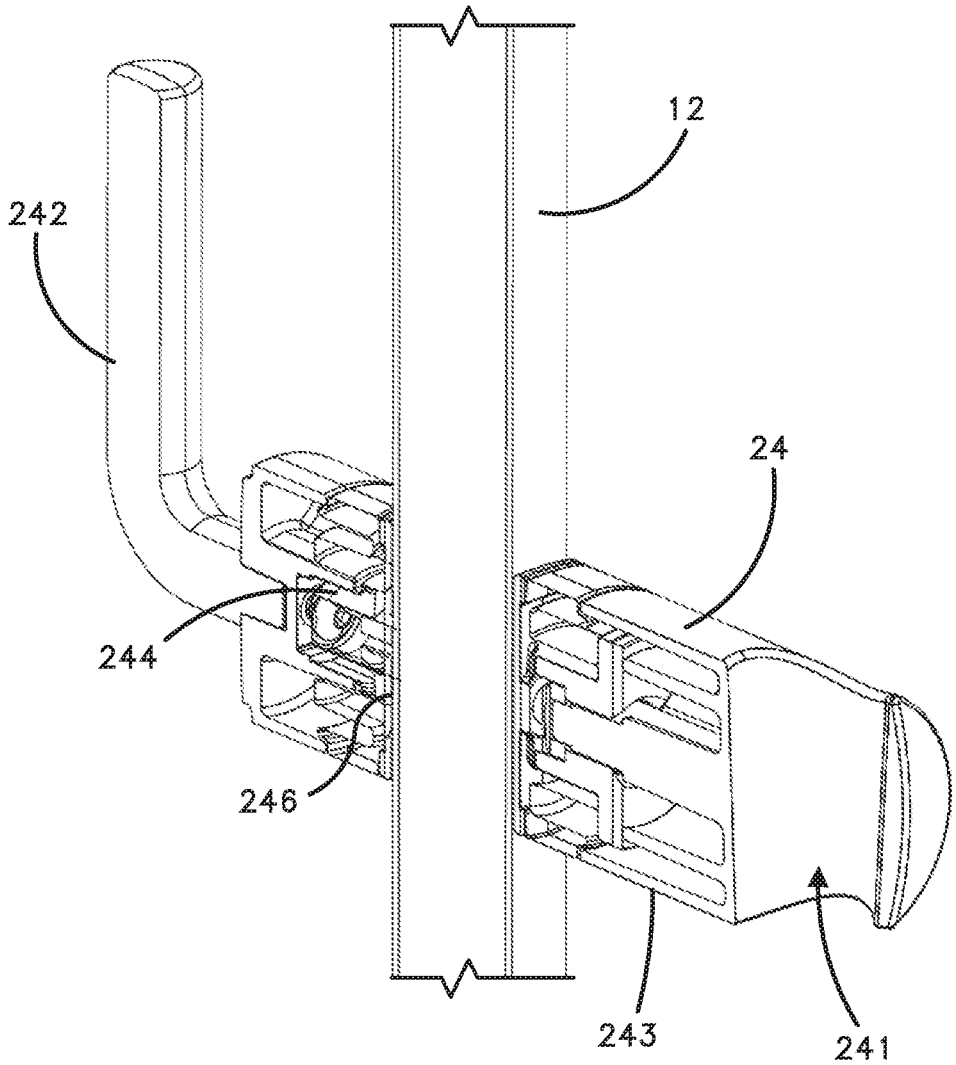
FIG. 24 is a perspective cross-sectional view of a hand shower mount attached to a portion of the shower column.

Referring now to FIG. 24, a cross-sectional view of the hand shower mount 24 of the shower column assembly 10 described herein is shown, according to one possible embodiment. The hand shower mount 24 is mountable to the shower column 12 at any selectable location between the first and second shower column mounts 12, 14, and thereby provides additional convenience and customization options for a user wishing to set a convenient height for the hand shower 20 and/or control of valve 201. In the example embodiment shown, rotation of the clamp handle 242 will rotate an internal camming mechanism 244, which compresses (or loosens) a portion of a pipe collar 246 positioned around the shower column 12 and within the clamp body 243. In example embodiments, the pipe collar 246 can be a rubberized or plastic anti-slip material that, when compressed against or around the shower column, affixes the hand shower mount 24 in a particular location and orientation along the shower column. When rotated/loosened, the pipe collar 246 will allow the user to reposition the hand shower mount 24, so it can be subsequently affixed in a different location.

FIG. 25 illustrates an alternative embodiment of a diverter body 200 having a flow restrictor 302. In the example shown, the diverter body 200 is shown in cross-section with a flow restrictor 302 located within a valve core 250. Upper and lower outlets 204, 206 allow water to flow toward the showerhead 18 and hand shower 20, respectively. The flow restrictor 302 is located within a lower seal portion 256 of the valve core 250.

In the embodiments described herein, the diverter 100 functions based on differential pressure and operates when the inlet pressure is high and the outlet pressure is low. Accordingly, when the flow restrictor 302 is located within the valve core 250 of the diverter 200, the flow restrictor 302 creates a preferable pressure environment as the pressure loss is at an area in the flow path of the water resulting in improved flow performance (e.g., as compared to when the flow restrictor is located further toward the hand shower 20).

In particular, the diverter 100 is able to function at comparatively lower operating pressures when the flow restrictor 302 is located within the vale core 250.

Accordingly, in conjunction with FIGS. 1-25 generally, the shower column assembly of the present disclosure provides advantages with respect to mounting simplicity while maintaining flexibility of mounting configuration. For example, in the embodiments discussed herein, a mounting adjustment at a second, lower mount may be used to ensure proper alignment and verticality of the shower column without having to also adjust the first (top) mount, which is a more complex mounting structure since it must also accommodate water flow. Additionally, since the valve and selection button for changing water flow is on the hand shower (in some embodiments), the quick-release clamping mechanism provided by the hand shower mount 24 allows a user to quickly adjust the hand shower positioning as desired. Other advantages are apparent as well, from the present disclosure.

Although operation of the shower column assembly 10 is described generally above with respect to certain embodiments, it is recognized that other embodiments are contemplated, consistent with the present disclosure. For example, in one variation, a valve can be located at or toward the showerhead 18 rather than at or toward the hand shower 20 from the diverter. In such an arrangement, diverter 100 may be inverted, such that a portion of the shower column between the diverter and the showerhead 18 is pressurized to provide water flow to the hand shower, rather than the opposite arrangement as noted above. Such an arrangement may be used, for example, with a gesture-controlled showerhead or other type of showerhead assembly (e.g., in which another hand shower is integrated with the showerhead).

EXAMPLES

Illustrative examples of the shower column assembly disclosed herein are provided below. An embodiment of the shower column assembly may include any one or more, and any combination of, the examples described below.

Example 1 is a shower column assembly that is connectable to a water supply having a supply pipe having a pipe outlet. The shower column assembly includes a shower column, as well as a first shower column mount and a second shower column mount. The first shower column mount includes a fluid conduit assembly connectable to a supply pipe, the fluid conduit assembly fluidically connected to the shower column at a supply location. The second shower column mount is positionable along the shower column at a secondary stabilization location. The shower column assembly further includes a showerhead fluidically connected at a first end of the shower column and a hand shower fluidically connected to the shower column via a hose connection at a second end of the shower column opposite the first end. A diverter is positioned within the shower column at the supply location, and a flow selection valve is positioned offset from the diverter along a fluid path defined, at least in part, by the shower column.

In Example 2, the subject matter of Example 1 is further configured such that the diverter is positioned offset toward the hand shower from the diverter and is adjustable between a first supply position and a second supply position, wherein in the first supply position, a first fluid path is defined through the diverter between the supply pipe and the showerhead, and in the second supply position, a second fluid path is defined through the diverter between the supply pipe and the hand shower.

In Example 3, the subject matter of Example 2 is further configured such that the diverter further includes a diverter body having an interior chamber and at least one fluid inlet location fluidically joining the interior chamber to the fluid conduit assembly. The interior chamber having an upper outlet and a lower outlet. The shower column assembly includes a valve core positioned at least in part within the interior chamber and including a base and an upper seal portion, the valve core having an outlet extending through the base and being in fluid communication with the lower outlet.

In Example 4, the subject matter of Example 3 is further configured such that the valve core is movable between the first supply position and the second supply position.

In Example 5, the subject matter of Example 2 is further configured to include a selector control button on the hand shower, the selector control button selectively actuating the flow selection valve.

In Example 6, the subject matter of Example 2 is further configured such that the flow selection valve is movable between first and second flow selection positions, and the diverter is movable between the first supply position and the second supply position in response to positioning of the flow selection valve in the first or second selection positions.

In Example 7, the subject matter of Example 1 is further configured such that the fluid conduit assembly includes a supply adapter fluidically connectable to the supply pipe and a supply bracket extending from the shower column at the supply location. The supply bracket is configured to sealingly join to the supply adapter to retain the shower column at a fixed position relative to the supply pipe.

In Example 8, the subject matter of Example 7 is further configured such that first shower column mount includes an escutcheon and a wall mount assembly. The escutcheon circumscribes at least a portion of the supply adapter and the supply bracket.

In Example 9, the subject matter of Example 7 is further configured such that the supply adapter is threaded to join to the supply pipe.

In Example 10, the subject matter of Example 9 is further configured such that the supply bracket includes at least one seal ring forming a fluidic seal around an outer circumference of the supply adapter.

In Example 11, the subject matter of Example 1 is further configured to include a hose connected between the second end of the shower column and the hand shower. The hose extends axially from the shower column.

In Example 12, the subject matter of Example 1 is further configured such that the second shower column mount includes a wall mount assembly and a stabilization bracket joinable to the wall mount assembly to define an adjustable distance between the wall mount assembly and the shower column.

In Example 13, the subject matter of Example 1 is further configured to include a hand shower mount positionable at an adjustable location along the shower column.

In Example 14, the subject matter of Example 1 is further configured to include a showerhead extension arm extending between the shower column and the showerhead.

In Example 15, the subject matter of Example 1 is further configured such that the flow selection valve is positioned within the hand shower.

In Example 16, the subject matter of Example 1 is further configured such that at least a portion of the shower column between the diverter and the hose connection has an interior volume forming a substantially continuous water column.

In Example 17, the subject matter of Example 1 is further configured such that the shower column lacks a valve positioned on the shower column between the diverter and the hose connection.

Example 18 is a shower column assembly connectable to a water supply having a supply pipe having a pipe outlet. The shower column assembly includes a shower column, as well as a first shower column mount and a second shower column mount. The shower column assembly further includes a showerhead fluidically connected at a first end of the shower column, and a hand shower fluidically connected to the shower column via a hose connection at a second end of the shower column opposite the first end. A diverter is positioned within the shower column at a supply location, the diverter including a diverter body and a valve core, the diverter body defining an interior body having an upper outlet and a lower outlet. The valve core is movable between first and second positions in response to fluid pressure in the shower column. In the first position, the valve core forms a fluid path between the supply pipe and the hand shower and a seal between the supply pipe and the showerhead, and in the second position, the valve core forms a fluid path between the supply pipe and the showerhead.

In Example 19, the subject matter of Example 18 is further configured to include a flow selection valve within the hand shower.

In Example 20, the subject matter of Example 18 is further configured such that the second shower column mount is positionable at an adjustable location along the shower column.

In Example 21, the subject matter of Example 20 is further configured such that the second shower column mount includes a wall mount assembly, a stabilization bracket, and an escutcheon circumscribing at least a portion of the wall mount assembly. The stabilization bracket is joinable to the wall mount assembly to define an adjustable distance between the wall mount assembly and the shower column.

Example 22 is a method of installing a shower column assembly that includes affixing a first shower column mount at a supply pipe location. This includes installing a wall mount at a supply adapter extending through a wall from a supply pipe, installing an escutcheon at least partially surrounding the supply adapter, and sealingly joining a supply bracket to the supply adapter to position a shower column at a fixed distance relative to the supply pipe, the shower column being fluidically connected to the supply bracket at a first position along the shower column and including a diverter at the first position, the shower column including a first end having a showerhead and a second end having a hose connection. The method further includes affixing a second shower column mount to the wall, the second shower column mount being movable along the shower column to a selected second position, the second shower column mount including a stabilization bracket being joinable to a wall mount assembly to define an adjustable distance between the wall mount assembly and the shower column. The method also includes connecting a hand shower to the second end of the shower column via a hose at the hose connection Example 23 is shower column assembly connectable to a water supply that has a supply pipe having a pipe outlet. The shower column assembly includes a shower column that includes a first shower column mount that includes a fluid conduit assembly connectable to a supply pipe. The fluid conduit assembly is fluidically connected to the shower column at a supply location. The shower column assembly includes a second shower column mount positionable along the shower column at a secondary stabilization location. The shower column assembly includes a showerhead fluidically connected at a first end of the shower column and a hand shower fluidically connectable to the shower column via a hose connection at a second end of the shower column opposite the first end. The shower column assembly includes a diverter positioned within the shower column at the supply location and a flow restrictor valve positioned in the diverter.

In Example 24, the subject matter of Example 23 is further configured such that the diverter further includes a diverter body having an interior chamber and at least one fluid inlet location fluidically joining the interior chamber to the fluid conduit assembly. The interior chamber has an upper outlet and a lower outlet. The diverter includes a valve core positioned at least in part within the interior chamber and including a base and an upper seal portion. The valve core has an outlet extending through the base and being in fluid communication with the lower outlet, and the flow restrictor is positioned within the valve core.

In Example 25, the subject matter of Example 23 is further configured such that the diverter functions based on differential pressure and operates when inlet pressure is high and outlet pressure is low.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The invention claimed is:

1. A shower column assembly connectable to a water supply having a supply pipe having a pipe outlet, the shower column assembly including:

a shower column;

a first shower column mount including a fluid conduit assembly connectable to the supply pipe, the fluid conduit assembly fluidically connected to the shower column at a supply location;

a second shower column mount positionable along the shower column at a secondary stabilization location;

a showerhead fluidically connected at a first end of the shower column;

a hand shower fluidically connectable to the shower column via a hose connection at a second end of the shower column opposite the first end;

a diverter positioned within the shower column at the supply location, wherein the diverter includes:

a diverter body having an interior chamber and at least one fluid inlet location fluidically joining the interior chamber to the fluid conduit assembly, the interior chamber having an upper outlet and a lower outlet; and a valve core positioned at least in part within the interior chamber and including a base and an upper seal portion, the valve core having an outlet extending through the base and being in fluid communication with the lower outlet; and a flow selection valve positioned offset from the diverter along a fluid path defined, at least in part, by the shower column, wherein the diverter is positioned offset toward the hand shower and is adjustable between a first supply position and a second supply position, wherein in the first supply position, a first fluid path is defined through the diverter between the supply pipe and the showerhead, and in the second supply position, a second fluid path is defined through the diverter between the supply pipe and the hand shower.

2. The shower column assembly of claim 1, wherein the valve core is movable between the first supply position and the second supply position.

3. The shower column assembly of claim 1, further comprising a selector control button on the hand shower, the selector control button selectively actuating the flow selection valve.

4. The shower column assembly of claim 1, wherein the flow selection valve is movable between first and second flow selection positions, and the diverter is movable between the first supply position and the second supply position in response to positioning of the flow selection valve in the first or second selection positions.

5. The shower column assembly of claim 1, wherein the fluid conduit assembly includes a supply adapter fluidically connectable to the supply pipe and a supply bracket extending from the shower column at the supply location, the supply bracket being configured to sealingly join to the supply adapter to retain the shower column at a fixed position relative to the supply pipe.

6. The shower column assembly of claim 5, wherein the first shower column mount includes an escutcheon and a wall mount assembly, the escutcheon circumscribing at least a portion of the supply adapter and the supply bracket.

7. The shower column assembly of claim 5, wherein the supply adapter is threaded to join to the supply pipe.

8. The shower column assembly of claim 7, wherein the supply bracket includes at least one seal ring forming a fluidic seal around an outer circumference of the supply adapter.

9. The shower column assembly of claim 1, further comprising a hose connected between the second end of the shower column and the hand shower, the hose extending axially from the shower column.

10. The shower column assembly of claim 1, wherein the second shower column mount includes a wall mount assembly and a stabilization bracket joinable to the wall mount assembly to define an adjustable distance between the wall mount assembly and the shower column.

11. The shower column assembly of claim 1, further comprising a showerhead extension arm extending between the shower column and the showerhead.

12. The shower column assembly of claim 1, wherein the flow selection valve is positioned within the hand shower.

13. The shower column assembly of claim 1, wherein at least a portion of the shower column between the diverter and the hose connection has an interior volume forming a substantially continuous water column.

14. A shower column assembly connectable to a water supply having a supply pipe having a pipe outlet, the shower column assembly including:

a shower column;

a first shower column mount including a fluid conduit assembly connectable to the supply pipe, the fluid conduit assembly fluidically connected to the shower column at a supply location;

a second shower column mount positionable along the shower column at a secondary stabilization location;

a showerhead fluidically connected at a first end of the shower column;

a hand shower fluidically connected to the shower column via a hose connection at a second end of the shower column opposite the first end;

a diverter positioned within the shower column at the supply location, the diverter including a diverter body and a valve core, the diverter body defining an interior body having an upper outlet and a lower outlet, wherein the valve core is movable between first and second positions in response to fluid pressure in the shower column;

wherein, in the first position, the valve core forms a fluid path between the supply pipe and the hand shower and a seal between the supply pipe and the showerhead, and in the second position, the valve core forms a fluid path between the supply pipe and the showerhead; and a flow restrictor valve positioned at the diverter.

15. The shower column assembly of claim 14, further comprising a flow selection valve positioned within the hand shower.

16. The shower column assembly of claim 14, wherein the second shower column mount includes a wall mount assembly, a stabilization bracket, and an escutcheon circumscribing at least a portion of the wall mount assembly, the stabilization bracket being joinable to the wall mount assembly to define an adjustable distance between the wall mount assembly and the shower column.

17. A shower column assembly connectable to a water supply having a supply pipe having a pipe outlet, the shower column assembly including:

a shower column;

a first shower column mount including a fluid conduit assembly connectable to the supply pipe, the fluid conduit assembly fluidically connected to the shower column at a supply location;

a second shower column mount positionable along the shower column at a secondary stabilization location;

a showerhead fluidically connected at a first end of the shower column;

a hand shower fluidically connectable to the shower column via a hose connection at a second end of the shower column opposite the first end;

a diverter positioned within the shower column at the supply location; and a flow restrictor valve positioned at the diverter.

18. The shower column assembly of claim 17, wherein the diverter further includes:

a diverter body having an interior chamber and at least one fluid inlet location fluidically joining the interior chamber to the fluid conduit assembly, the interior chamber having an upper outlet and a lower outlet; and a valve core positioned at least in part within the interior chamber and including a base and an upper seal portion, the valve core having an outlet extending through the base and being in fluid communication with the lower outlet, and wherein the flow restrictor valve is positioned within the valve core.

19. The shower column assembly of claim 18, wherein the diverter functions based on differential pressure and operates when inlet pressure is high and outlet pressure is low.

* * * * *